US007524138B2

(12) United States Patent
Koba

(10) Patent No.: US 7,524,138 B2
(45) Date of Patent: Apr. 28, 2009

(54) FLOOR SURFACE FINISHING DEVICE

(75) Inventor: Yoshiyuki Koba, Fukuoka (JP)

(73) Assignee: Yugengaisha Josei Kogyo, Fukuoka (JP)

( * ) Notice: Subject to any disclaimer, the term of this patent is extended or adjusted under 35 U.S.C. 154(b) by 24 days.

(21) Appl. No.: 10/578,349

(22) PCT Filed: Nov. 19, 2004

(86) PCT No.: PCT/JP2004/017289

§ 371 (c)(1),
(2), (4) Date: May 5, 2006

(87) PCT Pub. No.: WO2005/049940

PCT Pub. Date: Jun. 2, 2005

(65) Prior Publication Data

US 2007/0071553 A1 Mar. 29, 2007

(30) Foreign Application Priority Data

Nov. 21, 2003 (JP) ..... 2003-392864

(51) Int. Cl.
*E01C 19/22* (2006.01)

(52) U.S. Cl. ..... 404/112

(58) Field of Classification Search ..... 404/112, 404/118; 451/353
See application file for complete search history.

(56) References Cited

U.S. PATENT DOCUMENTS 2,900,883 A * 8/1959 Dening ..... 404/133.1
3,374,717 A * 3/1968 Reynolds, Jr. ..... 404/114
4,848,960 A * 7/1989 Kajioka et al. ..... 404/112
4,925,341 A * 5/1990 Neal ..... 404/112
5,379,479 A * 1/1995 Nelson ..... 15/245.1
5,909,981 A * 6/1999 Neuber, Jr. ..... 404/112
6,089,786 A * 7/2000 Allen et al. ..... 404/112
6,106,193 A * 8/2000 Allen et al. ..... 404/112
6,264,397 B1 * 7/2001 Majewski ..... 404/112
6,585,451 B2 * 7/2003 Wynings ..... 404/131

(Continued)

FOREIGN PATENT DOCUMENTS

JP 50-45025 5/1975

(Continued)

*Primary Examiner*—Gary S Hartmann
*Assistant Examiner*—Alina Schiller
(74) *Attorney, Agent, or Firm*—Wenderoth, Lind & Ponack, L.L.P.

(57) ABSTRACT

A floor surface finishing device includes a plane leveling machine having a plurality of rotary blades adapted to be rotated in a propeller manner by the driving force from a motor while keeping in contact with a floor surface to be finished. A planar finishing blade is connected to the planar leveling machine through a connecting member. In this state, the finishing blade is located in a portion of the outer peripheral regions of the planes of rotation of the rotary blades. Further, on the side opposite to the finishing blade of the plane leveling machine, an operating handle for the operator to manipulate the floor surface finishing device is attached. The final finishing operation on the floor surface to be finished can be conducted by placing the floor surface finishing device on the floor surface to be finished, rotating the rotary blades by the motor while pulling the operating handle to horizontally move the whole of the floor surface finishing device along the floor surface to be finished in the direction of an arrow A.

9 Claims, 18 Drawing Sheets

U.S. PATENT DOCUMENTS

| | | | | |
|---|---|---|---|---|
| 7,140,804 | B2 * | 11/2006 | Gregg | 404/93 |
| 2001/0006002 | A1 * | 7/2001 | Ueda et al. | 73/9 |

FOREIGN PATENT DOCUMENTS

| | | |
|---|---|---|
| JP | 50-73219 | 6/1975 |
| JP | 08-093212 | 4/1996 |
| JP | 08-184173 | 7/1996 |
| JP | 5-57198 | 7/2003 |
| JP | 2004-225523 | 8/2004 |

* cited by examiner

FLOOR SURFACE FINISHING DEVICE

TECHNICAL FIELD

This invention relates to a floor surface finishing device which is used in a construction site for a final finishing operation on a surface of a concrete or mortar floor after casting.

BACKGROUND ART

When constructing a floor surface with concrete or mortar, conventionally, ready-mixed concrete cast in a construction area is leveled to form a floor and left for several hours. Then, the surface of the floor is evenly pressed using a plane leveling machine called a trowel to form a flat surface, followed by a manual operation of a skilled worker with a finishing iron (a square iron) for a final finishing.

A typical plane leveling machine used in the above-described floor construction is a machine having a rotary blade which rotates like a propeller along with a motor for driving the rotary blade (see Patent Document 1, for example). Normal operating steps are: on a floor surface to be finished after casting of ready-mixed concrete and leveling, the above-mentioned plane leveling machine is placed, and the machine is moved backward and forward and from side to side along the floor surface while rotating a rotary blade with a motor.

Patent Document 1: Unexamined Japanese Utility Model Publication No. Hei 5-57198 (pages 2-5, FIG. 1)

In a conventional floor finishing operation, after a pressing operation using a plane leveling machine according to the above-described steps, a skilled worker completes the finishing with a manual operation. This requires considerable work and time to complete a floor construction, and also a worker has to endure a large amount of physical load. During a final finishing step, in particular, a worker almost crawls along a floor surface keeping a low posture with his/her back bending at nearly 90 degrees, and steps backward by about 20 cm per each move while pressing the floor surface with a finishing iron in his/her hand moving from side to side. Thus, in practice, a great deal of time and work is expended by a skilled worker on the final finishing.

In addition, since a final finishing operation must be completed before concrete or mortar cast in an operation site is hardened, if a floor to be constructed is wide, more than one skilled worker is needed. However, under a current situation where the number of skilled workers is decreasing, it is difficult to employ the necessary number of workers.

Furthermore, in a final finishing operation, as a worker has to remain in an unnatural posture over hours, the physical burden on his/her feet, back and/or shoulders is extremely large. Skilled workers engaging in final finishing operations, who have repeated such operations over a long period of time, suffer from chronic backache or shoulder ache even after finishing their operations.

An object of the present invention is to provide a floor surface finishing device which is easy to handle, capable of completing a final finishing operation on a floor surface in a relatively short time, and makes it possible to reduce the number of operators.

DISCLOSURE OF THE INVENTION

Problems to be Solved by the Invention

A floor surface finishing device according to the present invention comprises a plane leveling machine having a plurality of rotary blades which rotate in a propeller manner by a driving force while keeping in contact with a floor surface to be finished. A planar finishing blade which is connected to the plane leveling machine is disposed in a part of outer peripheral regions of planes of rotation (at an outer periphery of the circular area of rotation) of the rotary blades. The finishing blade is disposed so that at least a part of the finishing blade is brought into contact with the floor surface after the rotary blades have come into contact with and passed over the floor surface.

The floor surface finishing device having the above-described structure is placed on a floor surface to be finished, the rotary blades of the plane leveling machine are rotated by a driving force, and the whole of the floor surface finishing device is moved along the floor surface in a horizontal direction while maintaining the rotary blades preceding the finishing blade. Thus, the floor surface to be finished is leveled with pressure by the rotary blades, thereby completing a final finishing operation with the following finishing blade. Then, as the finishing blade is disposed so that at least a part of the finishing blade is brought into contact with the floor surface after the rotary blades have come into contact with and passed over the floor surface, the final finishing operation can be securely completed on the floor surface leveled by the rotary blades with pressure.

As described above, the floor surface finishing device can conduct both a leveling operation with pressure and a final finishing operation simply by moving the whole device along the floor surface to be finished in a horizontal direction. The device can be handled in an easy manner so that a final finishing operation of a floor surface can be completed in a relatively short time. Furthermore, since both a leveling operation with pressure and a final finishing operation can be achieved by one operator, the number of operators can be reduced and no skilled workers are needed.

Preferably, the above finishing blade may be slanted to have an angle of attack toward a pivotal center of the rotary blades. The finishing blade arranged in this manner can be moved forward while maintaining an angle of attack toward a moving direction of the floor surface finishing device, leading to a further improved final finishing.

In this case, preferably, an angle adjusting mechanism may be provided to vary an angle of attack of the finishing blade. With the angle adjusting mechanism, an angle of attack of the finishing blade can be set depending on each condition of constructing a floor surface. Thus, a suitable final finishing operation can be conducted in accordance with the type, property or curing condition of a floor surface material such as concrete or mortar.

It is also preferable that the above finishing blade may be movable in a direction including a moving direction along a pivotal center of the rotary blades (i.e., towards and away from the floor surface to be finished 2*a*). By this structure, the finishing blade can either come into contact with or separate from a floor surface to be finished (such floor surface being brought into contact with planes of rotation of the rotary blades). In other words, as the finishing blade can come into contact with or separate from a floor surface according to need, the finishing blade can be handled in an easy manner, improving its operability.

In addition, preferably, a pressing means may be provided to press the finishing blade against the floor surface to be finished. With this pressing means, the pressing force of the finishing blade against the floor surface can be increased, and thus the flattening and finishing efficiency to the floor surface is enhanced, which enables further improvement in the final finishing. Here, provided with a variable pressing force of the pressing means, a suitable final finishing operation can be conducted in accordance with the type, property or curing condition of a floor surface material such as concrete or mortar.

In this case, a plumb bob provided as the above pressing means exhibits a secure pressing effect despite its simple mechanism, and the pressing force can be varied simply by adjusting the weight of the plumb bob. Accordingly, as in the above-described cases, a suitable final finishing operation can be conducted in accordance with the type, property or curing condition of a floor surface material such as concrete or mortar.

It is also preferable that the finishing blade may be rotatable (swingable) around the rotary blades. By this structure, positional relations between an operator who handles the floor surface finishing device, the rotary blades, and the finishing blade can be varied. Therefore, while maintaining the positional relation in which the rotary blades are firstly brought into contact with a floor surface to be finished before the finishing blade comes into contact with the floor surface, an operator can move the floor finishing device in a direction to the back of the operator (in a pulling direction) or move the floor finishing device from side to side of the operator. Thus, operability and safety when conducting a finishing operation of a floor surface adjacent to a wall or pillar, or a floor surface with obstacles such as a hole, groove or protruding member, can be further enhanced.

Preferably, at least a part of the finishing blade may be formed of a flexible elastic plate. By this structure, when the finishing blade presses a floor surface to be finished, at least a part of the finishing blade bends so as to elastically press the floor surface, enabling tighter contact to the floor surface. Accordingly, the finished effect of a floor surface immediately after and over which the rotary blades have passed is improved, and a final finished surface has an excellent appearance.

It is also preferable that the finishing blade may be detachable from the plane leveling machine. By this structure, the finishing blade can be changed depending on conditions of a construction site, and a worn or damaged finishing blade can be replaced. Therefore, an optimal finishing operation is conducted in accordance with each construction site, and maintenance is also easier.

As another structure, a seat for an operator may be provided on a part of the plane leveling machine. By this structure, an operator can sit on the seat when conducting a floor finishing operation, which greatly alleviates a physical load of the operator.

According to the present invention, the following advantages can be obtained.

(1) A plane leveling machine has a plurality of rotary blades which rotate in a propeller manner by a driving force while keeping in contact with a floor surface to be finished, and a planar finishing blade which is connected to the plane leveling machine and is disposed in a part of outer peripheral regions of planes of rotation of the rotary blades. The finishing blade is disposed so that at least a part of the finishing blade is brought into contact with the floor surface after the rotary blades have come into contact with and passed over the floor surface. Thus, the device can be handled in an easy manner so that a final finishing operation of a floor surface can be completed in a relatively short time. Furthermore, the number of operators including skilled workers can be reduced.

(2) Because the finishing blade is slanted to have an angle of attack toward a pivotal center of the rotary blades, the finishing blade can be moved forward while maintaining an angle of attack toward a moving direction of the floor surface finishing device, leading to a further improved final finishing.

(3) Because an angle adjusting mechanism can vary an angle of attack of the finishing blade, the angle of attack of the finishing blade can be set depending on each condition of constructing a floor surface. Thus, a suitable final finishing operation can be conducted in accordance with the type, property or curing condition of a floor surface material such as concrete or mortar.

(4) Because the finishing blade is movable in a direction including a moving direction along a pivotal center of the rotary blades, the finishing blade can come into contact with or separate from a floor surface to be finished according to need. Therefore, the finishing blade can be handled in an easy manner, improving its operability.

(5) Because the pressing means presses the finishing blade against a floor surface to be finished, the pressing force of the finishing blade against the floor surface can be increased. Thus, the flattening and finishing efficiency of the floor surface is enhanced, which enables further improvement in the final finishing.

(6) Because a plumb bob is provided as a pressing means, a secure pressing effect is obtained despite its simple mechanism, and the pressing force can be varied simply by adjusting weight of the plumb bob. Accordingly, a suitable final finishing operation can be conducted in accordance with the type, property or curing condition of a floor surface material such as concrete or mortar.

(7) Because the finishing blade rotates around the rotary blades, positional relations between an operator who handles the floor surface finishing device, the rotary blades, and the finishing blade can be varied. Accordingly, the positional relation can be set depending on conditions of a construction site, improving operability and safety.

(8) Because at least a part of the finishing blade is formed with a flexible elastic plate, a finishing effect of a floor surface immediately after the rotary blades have passed is improved, and a final finished surface has an excellent appearance.

(9) Because the finishing blade is detachable from the plane leveling machine, the finishing blade can be changed depending on conditions of a construction site, and a worn or damaged finishing blade can be replaced. Therefore, an optimal finishing operation is conducted in accordance with each construction site, and maintenance is also easier.

(10) Because a seat for an operator is provided on a part of the plane leveling machine, an operator can sit on the seat when conducting a floor finishing operation, which greatly alleviates the physical load on the operator.

EXPLANATION OF REFERENCE NUMERALS

Figure 1:
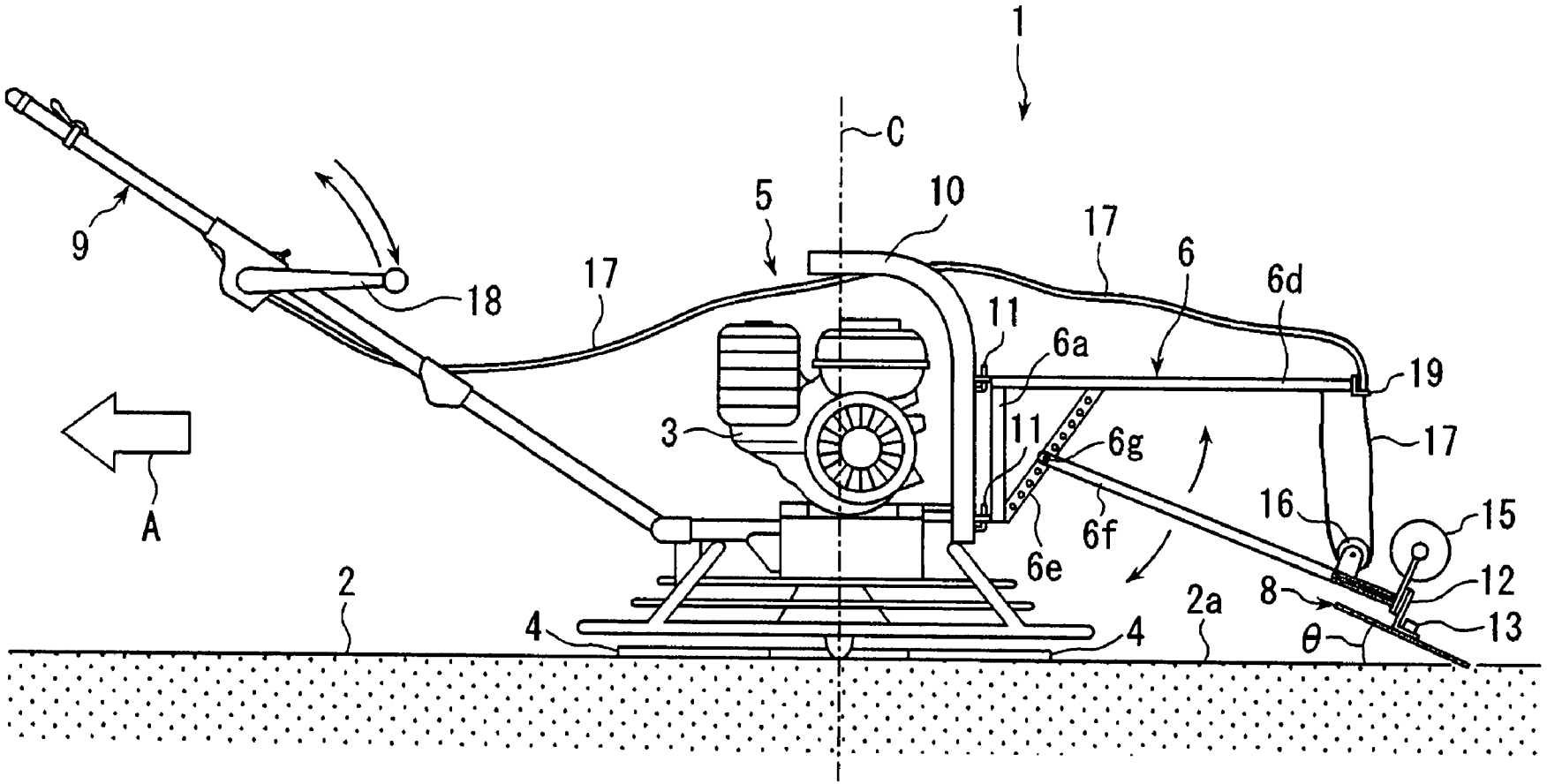
FIG. 1 is a side view illustrating a floor surface finishing device which is a first embodiment of the present invention.

1, 30, 40, 50, 60, 70, 80, 90, 100: floor surface finishing device
2, 2*a*: floor surface to be finished
3, 63: motor
4: rotary blade
5, 165: plane leveling machine
6, 20*a*, 20*c*, 26*j*, 36, 46: connecting member
6*a*, 36*a*, 46*a*, 56*a*, 62, 88: vertical shaft
6*b*: mounting member
6*c*: mounting hole
6*d*, 56*b*, 79: horizontal shaft
6*e*: supporting member
6*f*, 26*f*, 36*f*, 46*f*, 56*f*, 65, 74, 83, 96*f*, 106*f*: elevating arm
6*g*: mounting pin
6*h*: mounting hole
6*i*, 26*i*: attaching member
7: plane of rotation
8, 8*a*, 8*b*, 8*c*, 28, 68, 75, 84: finishing blade
8*d*, 92*b*: mounting member
8*e*, 46*b*, 46*c*: auxiliary member
9, H: operating handle
10: support
11: hook
12, 12*a*, 12*b*, 12*c*, 22: fixing member
12*d*: fixing portion
12*e*, 20*d*: connecting portion
13, 13*a*, 23: screw
14: horizontal bar
15: plumb bob
16, 30*a*, 30*b*, 30*c*, 30*d*, 40*a*, 40*b*, 40*c*, 40*d*, 50*a*, 50*b*, 50*c*, 50*d*, 67, 69, 76, 77, 86, 87: pulley
17, 37, 47, 57*a*, 57*b*, 66, 78, 85, 97*a*, 107: wire
18, 31, 41, 51*a*, 91*a*: elevating lever
19: wire guide
19*a*: guide hole
20: link mechanism
20*b*: hinge portion
20*e*, pin, 26*e*, 26*k*: connecting hole
21: shaft body
26*a*: reinforcing member
26*b*, 26*c*, 26*m*: tubular body
36*b*, 73: tubular member
46*g*, 56*g*, 56*c*, 64, 82, 93, 96*g*, 106*g*: shaft
46*i*, 81: slanting shaft
46*h*: stopper
56*d*: auxiliary elevating arm
61: hoist
51*b*, 91*b*: auxiliary elevating lever
92*a*: angle adjusting lever
101: switch
A, B, D1, D2: arrow
C: pivotal center
L: length
S: seat
T: thickness
W: width
θ: angle of attack

DETAILED DESCRIPTION OF THE INVENTION

Figure 2:
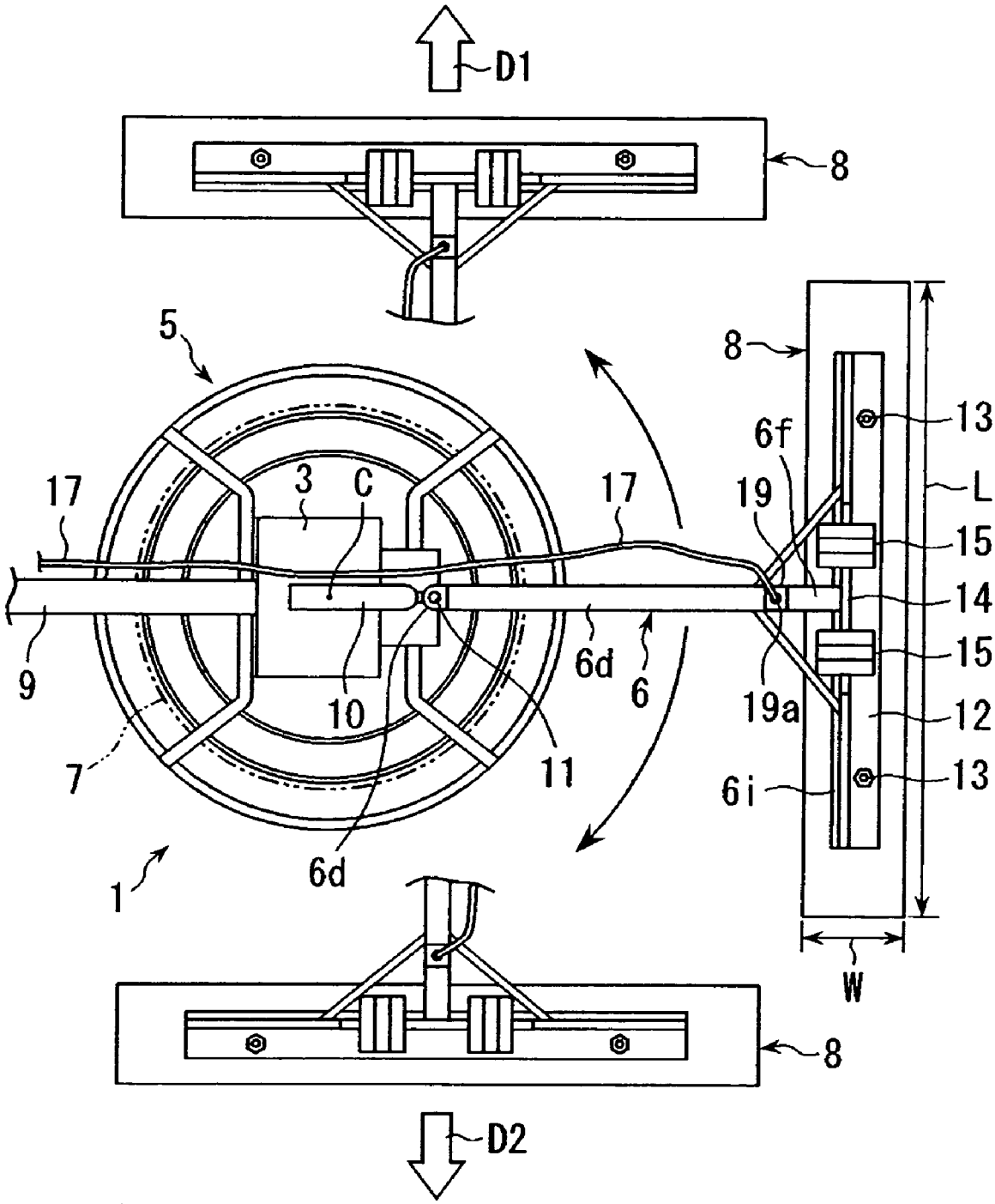
FIG. 2 is a partial plan view of the floor surface finishing device in FIG. 1.

With reference to FIGS. 1 to 4, a floor surface finishing device in a first embodiment of the present invention will be explained below. As shown in FIGS. 1 and 2, a floor surface finishing device 1 of this embodiment comprises a plane leveling machine 5 having a plurality of rotary blades 4 which rotate in a propeller manner by a driving force of a motor 3 while keeping in contact with a floor surface to be finished 2, and a planar finishing blade 8 which is connected to the plane leveling machine 5 via a connecting member 6 and is disposed in an outer peripheral region of planes of rotation 7 of the rotary blades 4. The plane leveling machine 5 further comprises, on the opposite side of the finishing blade 8, an operating handle 9 for operating the floor surface finishing device 1 by an operator.

Figure 3:
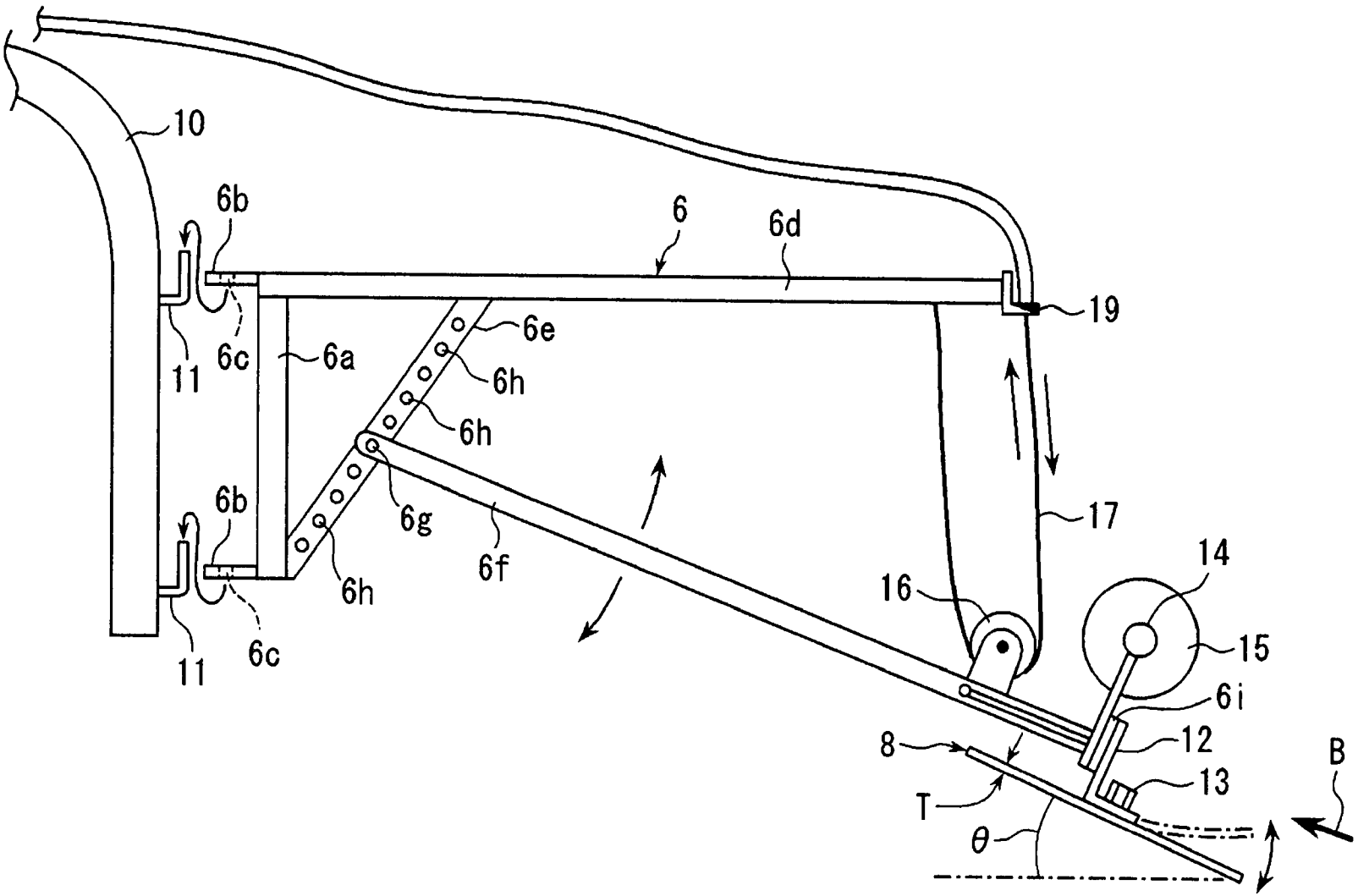
FIG. 3 is a side view of a finishing blade part constituting the floor surface finishing device in FIG. 1.
Figure 4:
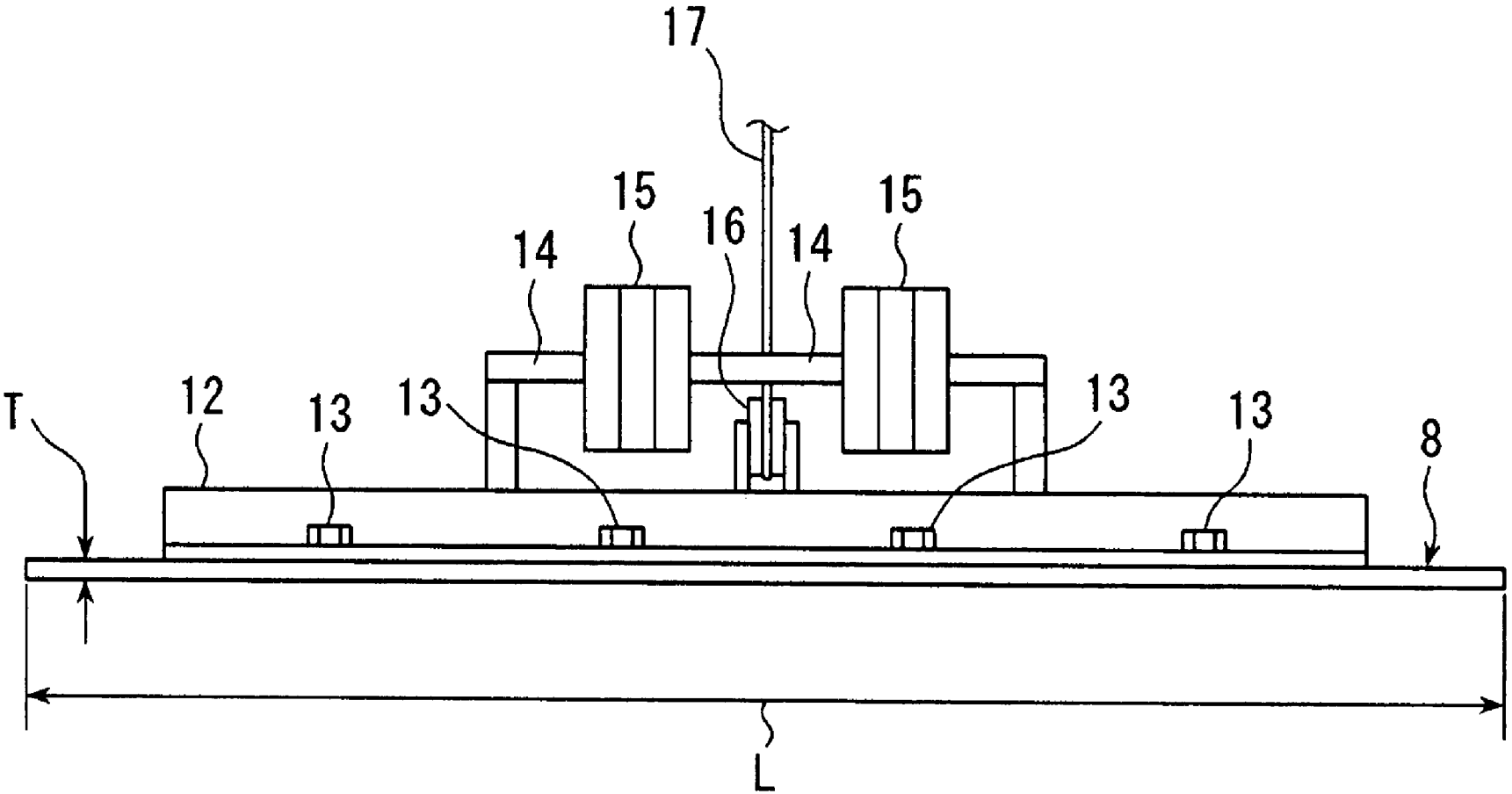
FIG. 4 is a view seen in a direction of an arrow B in FIG. 3.

As shown in FIG. 3, a support 10 having a reversed L-shape stands on a front portion of the motor 3 of the plane leveling machine 5. On each of upper and lower portions of a vertical part of the support 10, an L-shaped hook 11 is fixed. The L-shaped hook 11 is inserted into a mounting hole 6*c* of a mounting member 6*b* which is fixed on each of upper and lower portions of a vertical shaft 6*a* of the connecting member 6 so that the finishing blade 8 is connected to the plane leveling machine 5 via the connecting member 6.

The connecting member 6 comprises the above-mentioned vertical shaft 6*a*, a horizontal shaft 6*d* horizontally extending from the vertical shaft 6*a*, a supporting member 6*e* fixed aslant between the vertical shaft 6*a* and the horizontal shaft 6*d*, and an elevating arm 6*f* having a base end portion pivotally supported by the supporting member 6*e*. The base end portion of the elevating arm 6*f* is pivotally supported in a detachable manner by one of a plurality of mounting holes 6*h* which are open on the supporting member 6*e* via a mounting pin 6*g*. The base end portion of the elevating arm 6*f* can be selectively attached to one of the plurality of mounting holes 6*h*. Whichever of the mounting holes 6*h* is selected, the elevating arm 6*f* can be rotatable in upper and lower directions centering around the mounting pin 6*g*.

On a distal end portion of the elevating arm 6*f*, a fixing member 12 having an L-shaped section is fixed in a horizontal direction so as to form a T-shape with the elevating arm 6*f* and the fixing member 12 taken in a plan view. The planar finishing blade 8 is attached to the fixing member 12 along a longitudinal direction thereof. The finishing blade 8, which is fixed on a bottom surface of the fixing member 12 with a screw 13, is detachable from the fixing member 12 by loosening the screw 13. Thus, the finishing blade 8 can be replaced by another finishing blade with a different size, thickness or material depending on each construction condition such as a type or property of a floor surface to be finished. If a thumbscrew is used instead of the screw 13, the finishing blade can be detached without using tools such as a wrench.

Above a connecting portion of the elevating arm 6*f* and the fixing member 12, a horizontal bar 14 is provided parallel to the fixing member 12. Two plumb bobs 15 are attached to the horizontal bar 14 at symmetrical positions on both sides of the connecting portion. On a rear side of the connecting portion of the elevating arm 6*f*, a rotatable pulley 16 is disposed. A wire 17 having a distal end portion mounted on the horizontal shaft 6*d*, is hung on the pulley 16 to form a U-shape. A base end portion of the wire 17 passes through a guide hole 19*a* of a wire guide 19 on a distal end portion of the horizontal shaft 6*d* and is mounted to an elevating lever 18 of the operating handle 9.

In a state in which the connecting member 6 is being connected to the support 10, as shown in FIG. 2, the connecting member 6 is rotatable centering around the hook 11 (can swing around hook 11) in a horizontal direction. Therefore, by rotating the connecting member 6 as well as the finishing blade 8 depending on operating conditions, an operator manipulating the operating handle 9 can also conduct a finishing operation with the finishing blade 8 placed on either of a right or left side of the rotary blades 4 from the operator's viewpoint. If a distal end portion of a wire is mounted to an end portion of the horizontal bar 14 which supports the plumb bob 15 of the finishing blade 8, for example, and a base end portion of the wire is extended up to an operating handle, the finishing blade 8 can be rotated in a horizontal direction by tensing and loosening the wire.

Here, a use of the floor surface finishing device 1 is explained below. As shown in FIG. 1, the floor surface finishing device 1 is carried into a construction site and placed on the floor surface to be finished 2. The motor 3 is started to rotate the rotary blades 4 of the plane leveling machine 5. An operator pulls the operating handle 9 so that the whole of the floor surface finishing device 1 horizontally moves along the floor surface to be finished 2 toward a direction of an arrow A while the rotary blades 4 keep preceding the finishing blade 8.

By the above operation conducted by an operator, the floor surface to be finished 2 is leveled with pressure by the rotary blades 8, followed by a final finishing by the finishing blade 8. At this time, the finishing blade 8 is arranged so that an area close to one of the longitudinal sides of the finishing blade 8 is brought into contact with a floor surface to be finished 2*a* immediately after the rotary blades 4 have come into contact with and passed over the floor surface to be finished 2*a*. Accordingly, the floor surface to be finished 2*a* which has been leveled with pressure by the rotary blades 4 can be subject to a final finishing.

As described above, the floor surface finishing device 1 can level a floor surface with pressure and conduct a final finishing simply by rotating the rotary blades 4 with the motor 3 and horizontally moving the whole of the floor surface finishing device 1 to the direction of the arrow A along the floor surface to be finished 2 utilizing the rotary movement of the rotary blades 4. Therefore, the device is easy to handle and can complete a final finishing operation of the floor surface to be finished 2 in a relatively short time. Moreover, only one operator is necessary to manipulate the floor surface finishing device 1 to conduct both a leveling operation with pressure and a final finishing operation, which reduces the number of operators and does not need skilled workers.

In the above-described embodiment, the finishing blade 8 is tilted so as to have an angle of attack θ toward a pivotal center C of the rotary blades 4. In other words, the finishing blade 8 is angled upwards towards the center axis of rotation C of the rotary blades 4 so as to form an angle θ with respect to the surface to be finished 2*a*, as shown in FIG. 1. Therefore, the finishing blade 8 can maintain the angle of attack θ while moving forward in a moving direction of the floor surface finishing device 1. Thus, the floor surface finally finished by the finishing blade 8 has an excellent appearance.

In addition, as an angle adjusting mechanism to vary the angle of attack θ of the finishing blade 8, provided are the supporting member 6*e* having the plurality of mounting holes 6*h* and the elevating arm 6*f* which can be pivotally supported by one of the mounting holes 6*h* selectively. Accordingly, if the base end portion of the elevating arm 6*f* is pivotally supported by the mounting holes 6*h* located on an upper side and close to the horizontal shaft 6*d*, the angle of attack θ of the finishing blade 8 becomes larger. On the other hand, if the base end portion of the elevating arm 6*f* is supported by the mounting holes 6*h* located on a lower side and close to the vertical shaft 6*a*, the angle of attack θ of the finishing blade 8 becomes smaller.

With the angle adjusting mechanism described above, the angle of attack θ of the finishing blade 8 can be set depending on construction conditions of the floor surface to be finished 2, and thus a suitable final finishing operation can be conducted in accordance with the type, property or curing condition of a floor surface material such as concrete or mortar.

By tilting the elevating lever 18 provided on the operating handle 9, the elevating arm 6*f* moves (pivots) up and down centering around the mounting pin 6*g* via the wire 17. Thus, the elevating arm 6*f* forms part of a lifting mechanism for moving the finishing blade 8 in upper and lower directions (a direction substantially parallel to the pivotal center C of the rotary blades 4 and away from and toward the surface to be finished 2*a*). Thus, the finishing blade 8 can be brought into contact with or separate from the floor surface to be finished 2 which comes into contact with the planes of rotation 7 of the rotary blades 4. Namely, by tilting the elevating lever 18 according to need, the finishing blade 8 can either come into contact with or separate from the floor surface to be finished 2, thereby realizing easier handling and enhancing operability.

Furthermore, the plumb bob 15 for pressing the finishing blade 8 against the floor surface to be finished 2*a* increases the pressing force of the finishing blade 8 onto the floor surface to be finished 2*a*. Therefore, an excellent finishing effect on the floor surface to be finished 2*a* can be obtained to improve the condition after final finishing. In addition, since the plumb bob 15 can be detached from the horizontal bar 14, the weight of the plumb bob 15 can be changed by varying the volume, number or material thereof. A suitable final finishing operation can be conducted in this manner in accordance with the type, property or curing condition of a floor surface material such as concrete or mortar.

As described above, the finishing blade 8, which is horizontally rotatable (pivotable) centering around the hook 11, can be horizontally rotated (swung) around the rotary blades 4 and held at an optional position. Therefore, it is possible to change a positional relation between an operator (not shown) standing near an end portion of the operating handle 9 to manipulate the floor surface finishing device 1, the rotary blades 4, and the finishing blade 8. Thus, in addition to a basic use for conducting a floor finishing operation shown in FIG. 1 in which an operator (not shown) moves the floor surface finishing device 1 by pulling it in the direction of the arrow A, a floor surface finishing operation can also be conducted with the finishing blade 4 disposed on either right or left side of the rotary blades 8 as shown in FIG. 2.

Specifically, as shown in FIG. 2, the entire floor surface finishing device 1 can be moved in a direction of an arrow D1 with the finishing blade 8 disposed on a right side of the rotary blades 4 seen from the operating handle 9 (a bottom side on the paper of FIG. 2). Alternatively, the whole of the floor surface finishing device 1 can be moved in a direction of an arrow D2 with the finishing blade 8 disposed on a left side of the rotary blades 4 (a top side on the paper of FIG. 2). In either method of use, a floor surface finishing operation can be conducted while maintaining a positional relation in which the finishing blade 8 is brought into contact with the floor surface 2*a* after the rotary blades 4 have come into contact with and passed over the floor surface 2*a*. Therefore, when finishing a floor surface adjacent to a wall or pillar, or a floor surface with obstacles such as a hole, groove or protruding member, the moving direction of the floor surface finishing device 1 can be set depending on conditions of the construction sites, which improves operability. A danger of encountering the above obstacles for an operator moving backward in the state shown in FIG. 1 can be avoided by employing the operating methods to move the device in the direction of the arrow D1 or D2, leading to a safer operation.

The rotary blades 4 rotate clockwise in a plan view (a state shown in FIG. 2). Therefore, the plane leveling machine 5 has a character of moving in the direction of the arrow D1 by lifting up the operating handle 9 (moving the handle 9 away from the floor surface). On the other hand, the plane leveling machine 5 has a character of moving in the direction of the arrow D2 by lowering the operating handle (moving the handle 9 toward the floor surface). Accordingly, when the finishing blade 8 is disposed on either right or left side of the rotary blades 4, an operation is efficiently conducted by utilizing this character in the movement of the plane leveling machine 5.

In this embodiment, the finishing blade 8 is formed of a flexible elastic plate (a stainless steel plate or a special steel plate having a thickness T of 0.3 to 0.7 mm, a width W of 50 mm to 250 mm, and a length L of 700 mm to 3000 mm, for example). This enables tighter contact to the floor surface to be finished 2*a* immediately after the rotary blades 4 have passed, and a final condition after finishing is excellent in its appearance.

The length L of the finishing blade 8 is larger than a diameter of the plane (circular area) of rotation 7 of the rotary blades 4, and a direction along the length L of the finishing blade 8 is arranged parallel to a tangential direction of an outer periphery of the plane (circular area) of rotation 7. In this manner, after the rotary blades 4 have come into contact with and passed over the floor surface to be finished 2*a*, the finishing blade 8 is always brought into contact with and passes over the floor surfaces to be finished 2*a* to complete a final finishing, which secures a final finishing operation. The use of the floor surface finishing device 1 can shorten the work period for a floor surface finishing operation up to one-seventh to one-tenth compared to conventional construction methods.

In the floor surface finishing device 1 of the present (first) embodiment, an operator manually conducts up-and-down moving operations of the finishing blade 8 (moving operations in a direction including a moving direction parallel to the pivotal center C of the rotary blades 4) and a horizontal rotating operation of the finishing blade 8 centering around the hook 11. Alternatively, these operations can be motorized by providing mechanisms powered by the motor 3 or by an electric motor with a battery as a power source, such as a hydraulic, gear, wire, link, belt, chain and cam mechanisms. With the mechanisms, physical load of an operator can be further alleviated.

Figure 5:
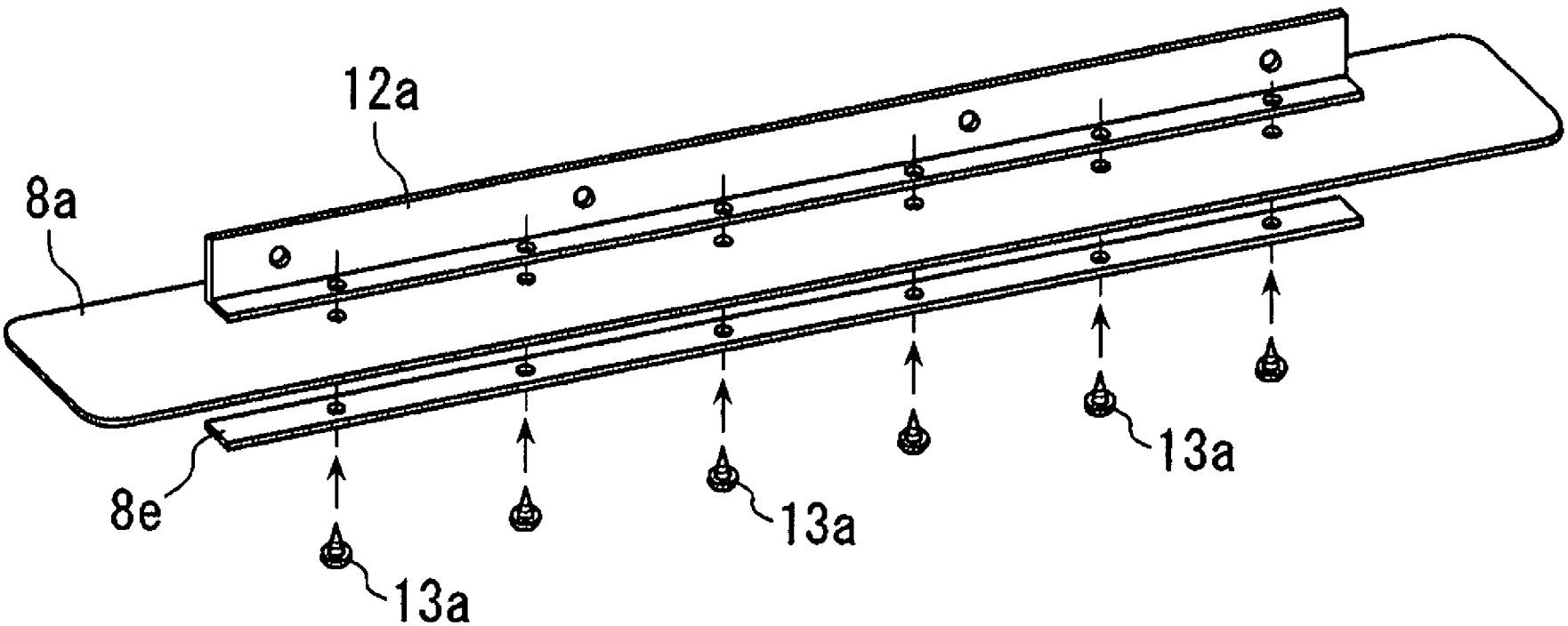
FIG. 5 is an exploded perspective view illustrating a finishing blade of another embodiment.

Next, with reference to FIGS. 5 to 9, other embodiments of a finishing blade will be explained below. A finishing blade 8*a* shown in FIG. 5 is formed of a flexible elastic plate as in the above-described finishing blade 8 and has a substantially rectangular shape with all of the four corners made round. On a top surface of the finishing blade 8*a* is a fixing member 12*a* having an L-shaped section, and an auxiliary member 8*e* is disposed on a bottom surface of the finishing blade 8*a*, into which a plurality of screws 13*a* are screwed from a bottom side. Thus, the fixing member 12*a* and the finishing blade 8*a* are fixed. The finishing blade 8*a*, as in the finishing blade 8, can be attached to the floor surface finishing device 1 shown in FIGS. 2 and 3 in use. In this case, the fixing member 12*a* located on the top surface of the finishing blade 8*a* is fixed to a mounting member 6*i* on the distal end of the elevating arm 6*f* of the floor surface finishing device 1 shown in FIGS. 2 and 3 via a screw (not shown) in use. Since the finishing blade 8*a* is fixed to the fixing member 12*a* with the auxiliary member 8*e* and the screws 13*a* provided on the bottom surface of the fixing member 12*a*, the secure fixing state is further improved and the fixing blade 8*a* has a strong resistance against deformation.

Figure 6:
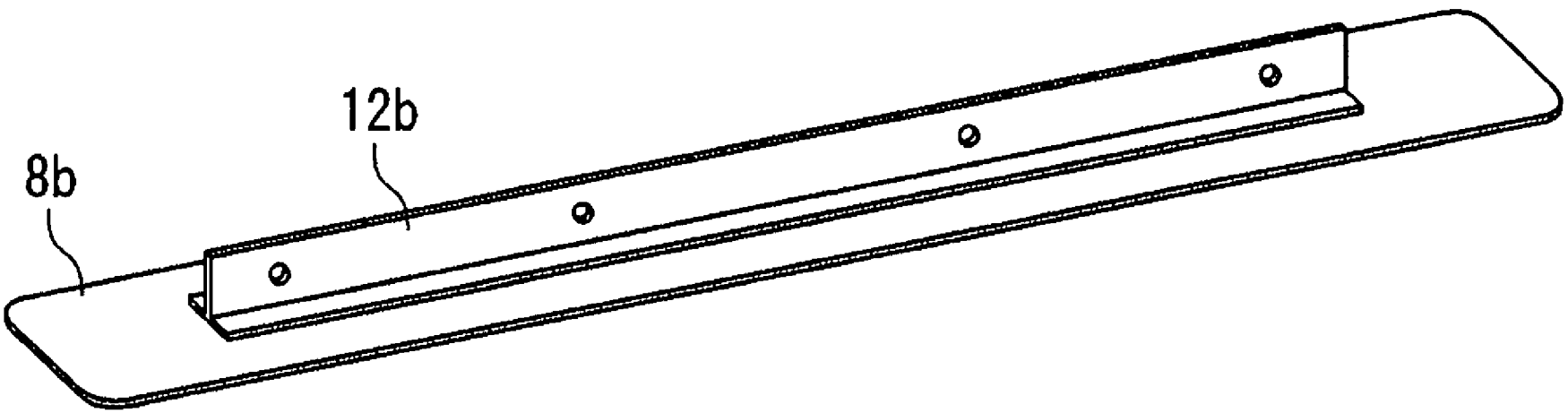
FIG. 6 is a perspective view illustrating a finishing blade of another embodiment.

A finishing blade 8*b* shown in FIG. 6 is formed of a flexible elastic plate and has a substantially rectangular shape with all of the four corners made round as in the above-described finishing blade 8*a*. On a top surface of the finishing blade 8*b*, firmly attached is a fixing member 12*b* having a reversed T-shaped section. In use, similar to the finishing blade 8*a*, the finishing blade 8*b* is fixed to the mounting member 6*i* on the distal end of the elevating arm 6*f* of the floor surface finishing device 1 shown in FIGS. 2 and 3 via a screw (not shown). The fixing member 12*b* is firmly attached to the finishing blade 8*b* by fixing means such as spot welding, hot welding or an adhesive.

Figure 7:
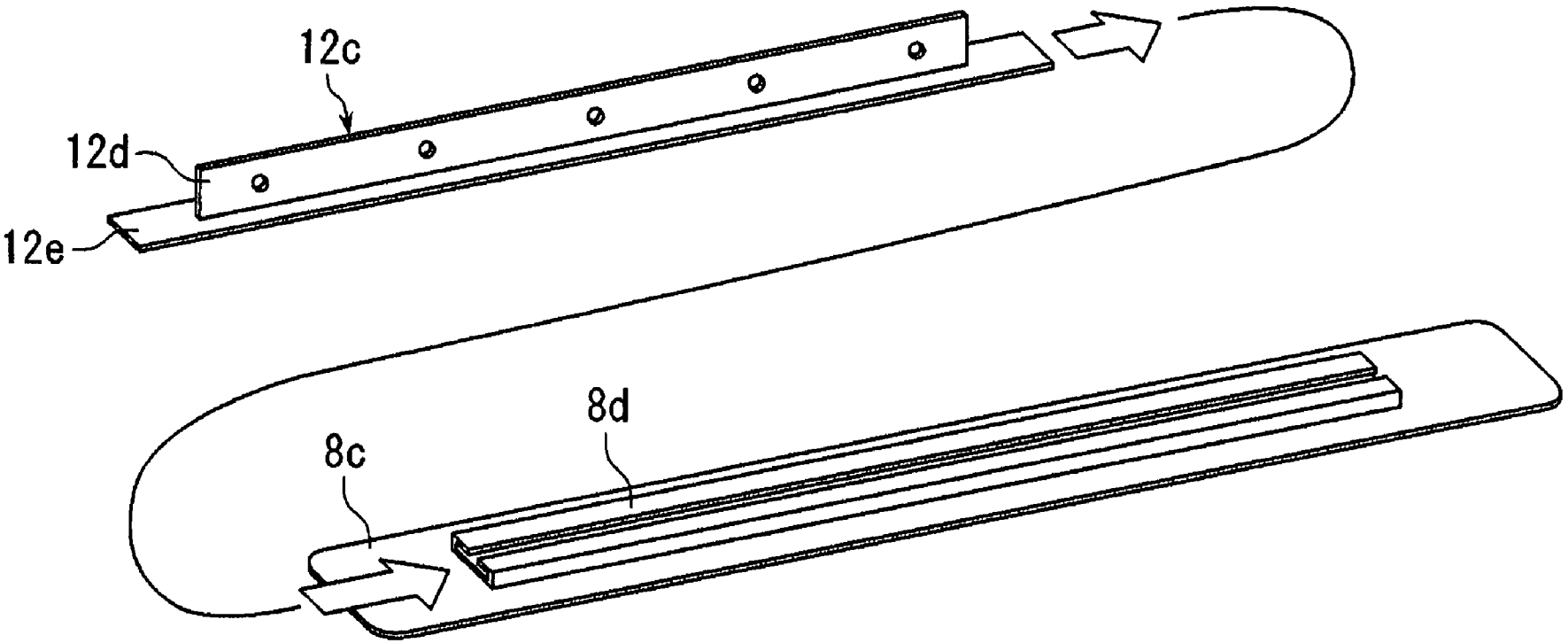
FIG. 7 is an exploded perspective view illustrating a finishing blade of another embodiment.

On a surface of a finishing blade 8*c* shown in FIG. 7, firmly attached is a mounting member 8*d* having a substantially C-shaped section. A fixing member 12*c* having a T-shaped section is slid into a groove of the mounting member 8*d* along its longitudinal direction so that the fixing member 12*c* can be detachably fixed to the finishing blade 8*c*. The fixing member 12*c* comprises a connecting portion 12*e* which is inserted into the groove of the mounting member 8*d* in a posture to face the finishing blade 8*c* and a fixing portion 12*d* which is firmly attached on a top surface of the connecting portion 12*e* to form a rib. In use, the fixing member 12*c* is attached to the finishing blade 8*c*, and the fixing portion 12*d* of the fixing member 12*c* is fixed to the mounting member 6*i* on the distal end of the elevating arm 6*f* of the floor surface finishing device 1 shown in FIGS. 2 and 3 with a screw (not shown). In this embodiment, the finishing blade 8*c* is detachable while the fixing member 12*c* is being attached to the floor surface finishing device 1, which accelerates operations for detaching and replacing the finishing blade 8*c*.

Figure 8:
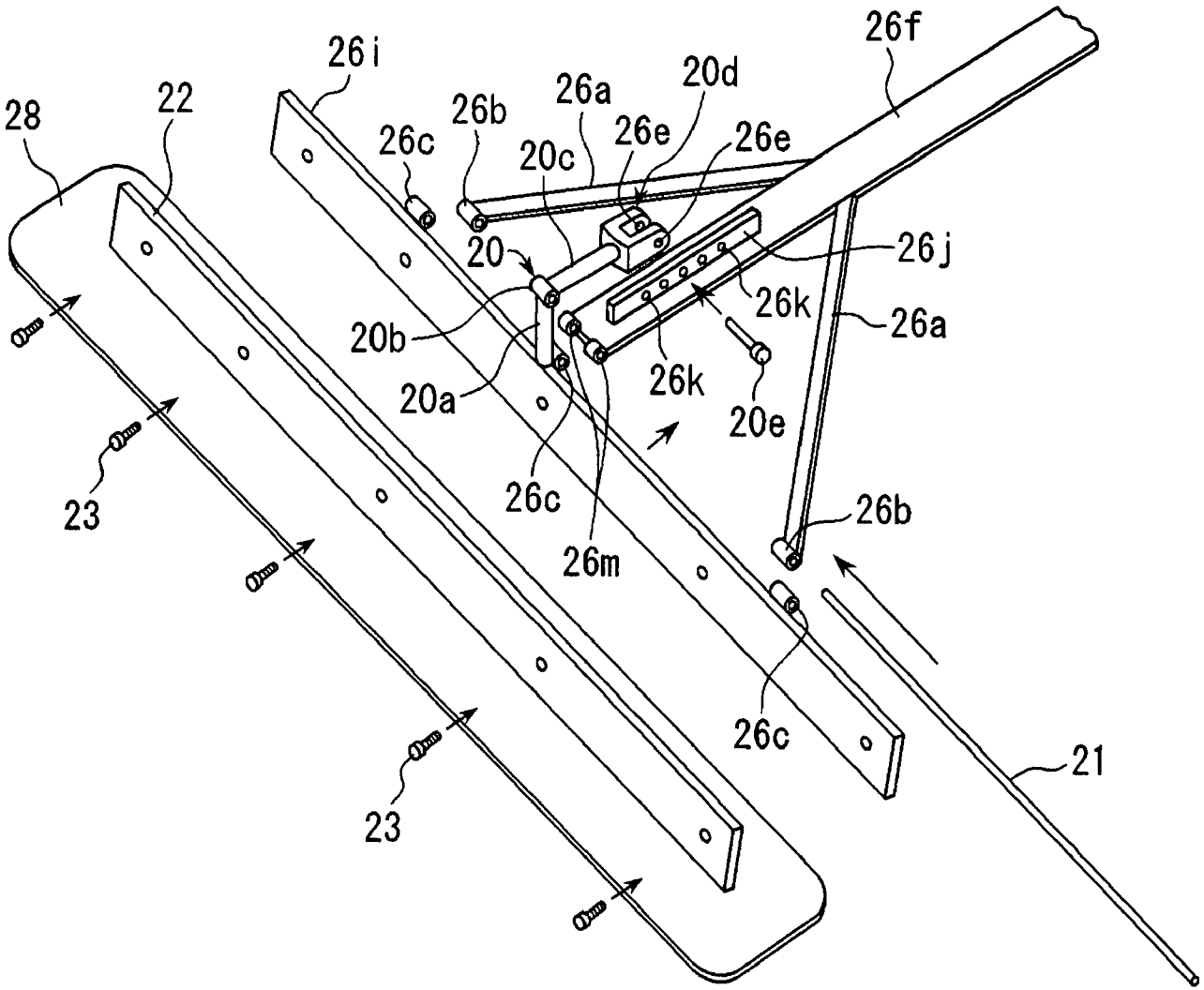
FIG. 8 is an exploded perspective view illustrating a finishing blade and its detaching mechanism of another embodiment.
Figure 9:
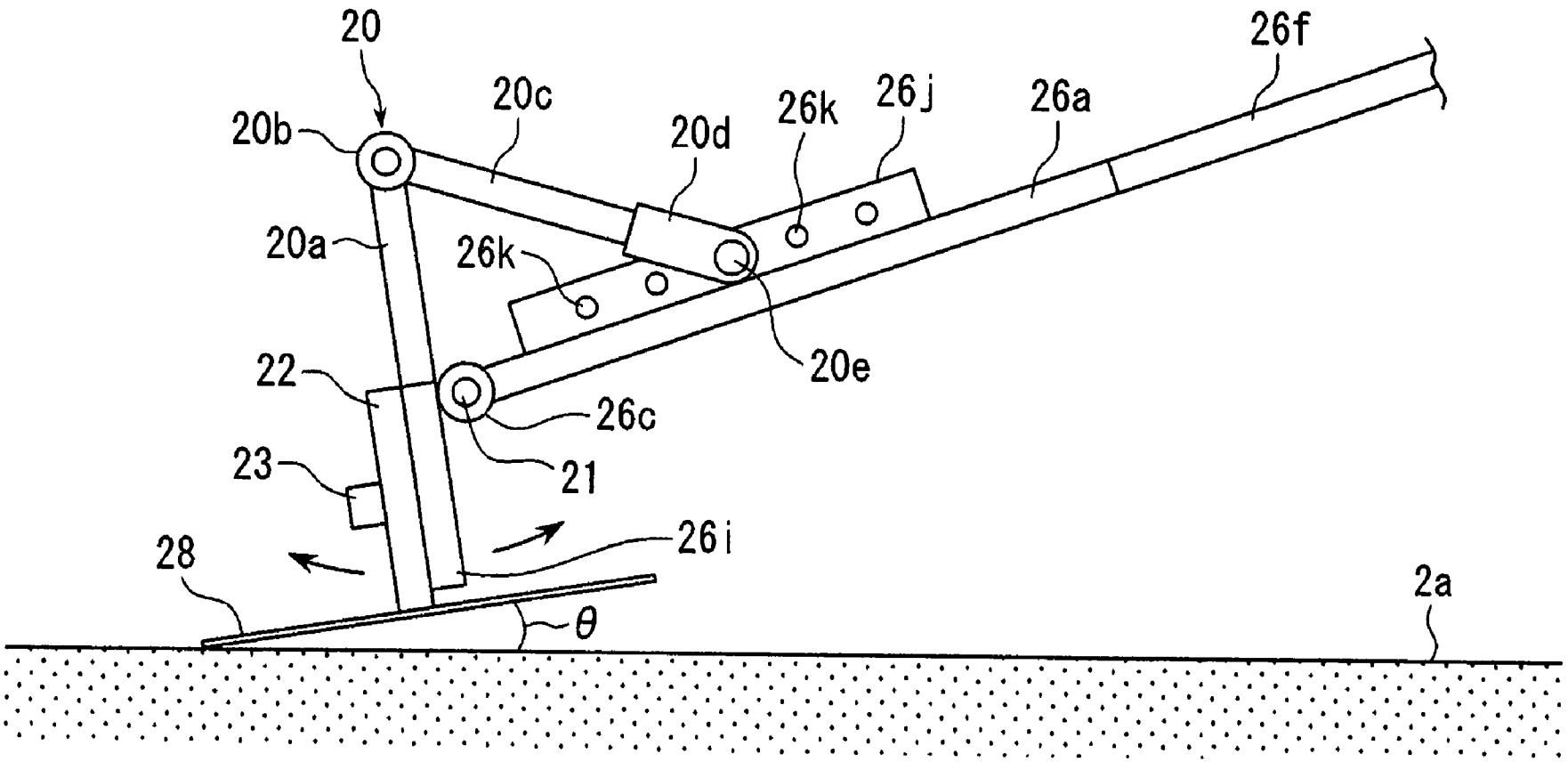
FIG. 9 is a side view illustrating a condition of a floor surface finishing operation by the finishing blade in FIG. 8.

When using a finishing blade 28 shown in FIGS. 8 and 9, a fixing member 22 firmly attached on a surface thereof is fixed with a plurality of screws 23 to a mounting member 26*i* which is tiltably mounted on a distal end of an elevating arm 26*f* of a floor surface finishing device (not shown). A plurality of tubular bodies 26*c* firmly attached to an upper edge of the mounting member 26*i* are arranged so as to be coaxial to a plurality of tubular bodies 26*m* firmly attached to a distal end of the elevating arm 26*f* and a tubular body 26*b* firmly attached to a distal end of a plurality of reinforcing members 26*a* which extend from the elevating arm 26*f*. A shaft body 21 is inserted into these tubular bodies 26*b*, 26*c* and 26*m* so that the mounting member 26*i* is tiltably mounted centering around the shaft body 21 as shown in FIG. 9.

Between a vicinity of a center of the upper edge of the mounting member 26*i* and a vicinity of the distal end of the elevating arm 26*f* is a link mechanism 20 which comprises two connecting members 20*a* and 20*c* connected to each other by a hinge portion 20*b*. An end portion of the connecting member 20*a* is firmly fixed to the upper edge of the mounting member 26*i*. A connecting hole 26*e* of a U-shaped connecting portion 20*d* firmly attached to an end portion of the connecting member 20*c* is brought to correspond with one of a plurality of connecting holes 26*k* which are opened on a connecting member 26*j* firmly fixed to a vicinity of the distal end of the elevating arm 26*f*. Then, a pin 20*e* is inserted into the connecting holes 26*e* and 26*k* so that the mounting member 26*i* along with the finishing blade 28 and the other members are fixed to the elevating arm 26*f*.

In this case, depending on the hole among the plurality of connecting holes 26*k* on the connecting member 26*j* selected to correspond with the connecting hole 26*e* of the connecting portion 20*d* on the end portion of the connecting member 20*c*, an angle of the mounting member 26*i* mounted to the elevating arm 26*f* can be set. Thus, an angle of attack θ of the finishing blade 28 to the floor surface to be finished 2*a* can be selectively set, thereby obtaining the optimal angle of attack θ for each operating condition.

Next, with reference to FIGS. 10 to 12, floor surface finishing devices according to second to fourth embodiments of the present invention will be explained below. In components of floor surface finishing devices 30, 40 and 50 shown in FIGS. 10 to 12, the components which have the same structures and functions as those of the above-mentioned floor surface finishing device 1 bear the same reference numerals as in FIGS. 1 to 4 and the explanations are omitted.

Figure 10:
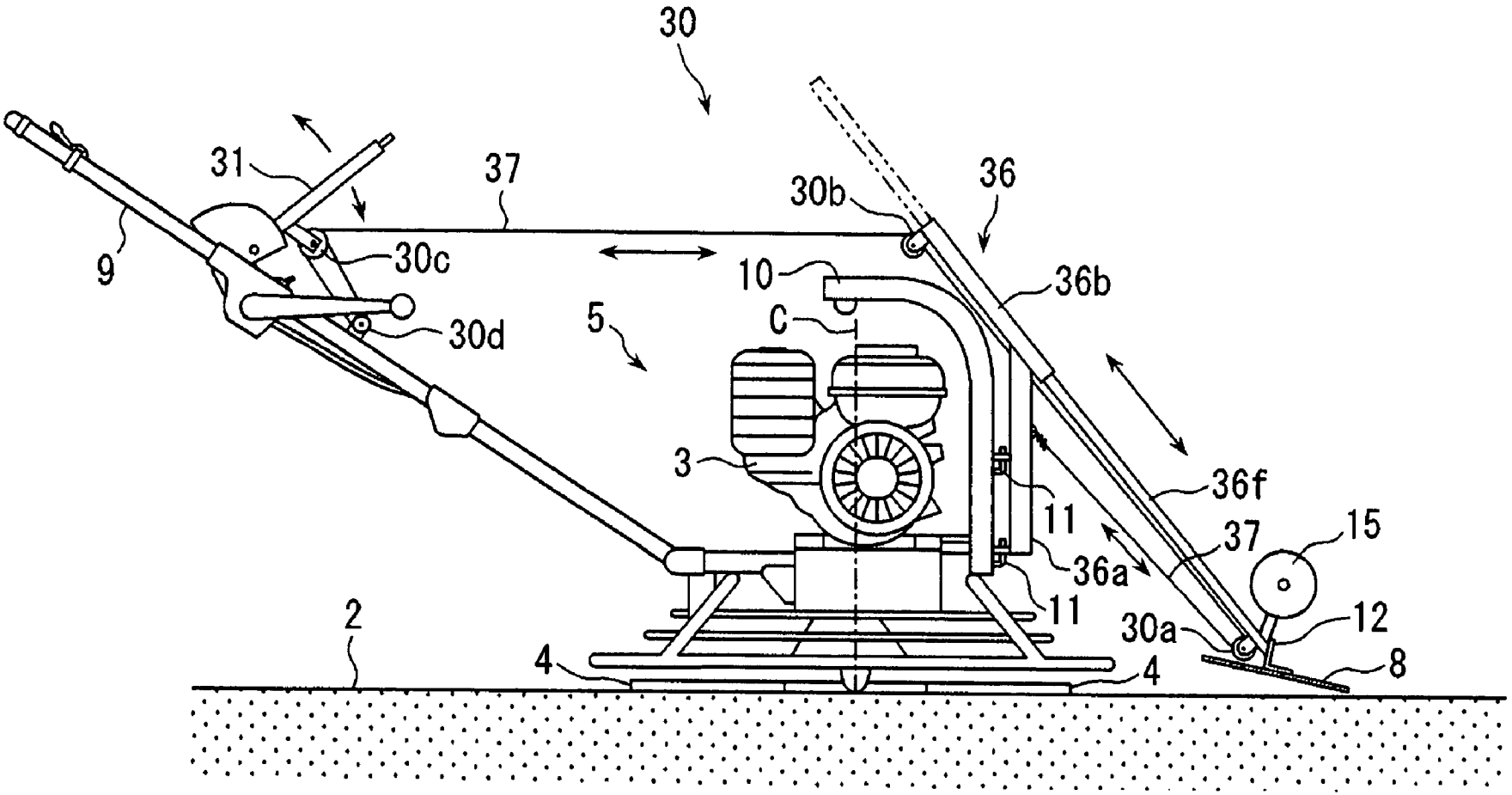
FIG. 10 is a side view illustrating a floor surface finishing device which is a second embodiment of the present invention.

In the floor surface finishing device 30 shown in FIG. 10, a vertical shaft 36*a* of a connecting member 36 is mounted on a hook 11 provided on a support 10 of a plane leveling machine 5. A tubular member 36*b* is fixed on an upper end of the vertical shaft 36*a* so as to downwardly incline toward the front of the finishing device 30. An elevating arm 36*f* is slidably inserted inside the tubular member 36*b*. A wire 37 with its distal end portion fixed to the vertical shaft 36*a* extends through a pulley 30*a* provided on a distal end portion of the elevating arm 36*f*, a pulley 30*b* provided on an upper end portion of the tubular member 36*b*, a pulley 30*c* provided on an elevating lever 31 which can be tiltably operated, and a pulley 30*d* provided on an operating handle 9, to reach a pulley 30*c* and be fixed thereto.

When the elevating lever 31 is tilted, the wire 37 is let in and out, thereby sliding the elevating arm 36*f* upward and downward along a longitudinal direction of the tubular member 36*b*. In this manner, a finishing blade 8 can come into contact with or separate from a floor surface to be finished 2*a*. In the case of the floor surface finishing device 30, an elevating mechanism for the finishing blade 8 can be formed of the tubular member 36*b* and the elevating arm 36*f*, which simplifies the structure of the device.

Figure 11:
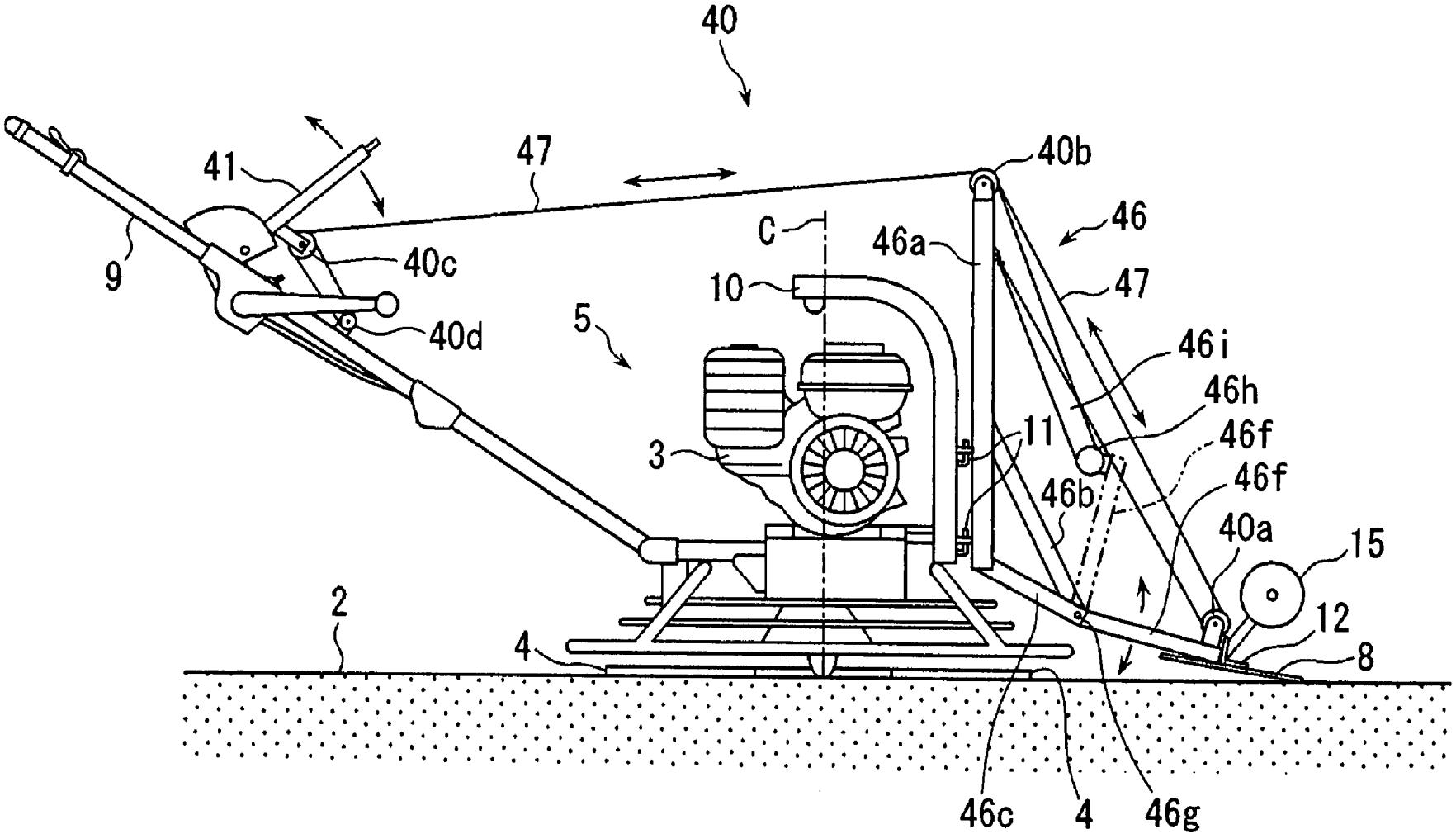
FIG. 11 is a side view illustrating a floor surface finishing device which is a third embodiment of the present invention.

In the floor surface finishing device 40 shown in FIG. 11, a vertical shaft 46*a* of a connecting member 46 is mounted on a hook 11 provided on a support 10 of a plane leveling machine 5. An elevating arm 46*f* is rotatably mounted, via a shaft 46*g*, on auxiliary members 46*b* and 46*c* which are fixed to a lower end portion of the vertical shaft 46*a*. A pulley 40*b* is provided on an upper end of the vertical shaft 46*a*. A slanting shaft 46*i* obliquely extends downward from an upper end portion of the vertical shaft 46*a*, of which distal end has a stopper 46*h* to define an elevated position of the elevating arm 46*f*. A wire 47 with its distal end fixed to the vertical shaft 46*a* extends through a pulley 40*a* provided on a distal end portion of the elevating arm 46*f*, a pulley 40*b* provided on an upper end portion of the vertical shaft 46*a*, a pulley 40*c* provided on an elevating lever 41 which can be tiltably operated, and a pulley 40*d* provided on an operating handle 9, to reach a pulley 40*c* and be fixed thereto.

When the elevating lever 41 is tilted, the wire 47 is let in and out, thereby rotating the elevating arm 46*f* centering around the shaft 46*g* in a predetermined angle. In this manner, a finishing blade 8 can come into contact with or separate from a floor surface to be finished 2*a*. In the case of the floor surface finishing device 40, the finishing blade 8 can be lifted and lowered by rotation of the elevating arm 46*f* which is relatively short. Thus, the elevating mechanism can be made compact. In addition, when the elevating arm 46*f* is lifted up to be nearly vertical by largely tilting the elevating lever 41, the finishing blade 8 as well as a plumb bob 15 can be housed on a side of the plane leveling machine 5. In this case, the plumb bob 15 approaches a center of gravity of the plane leveling machine 5, which prevents decline of operability when only the function of the plane leveling machine 5 is used for operation.

Figure 12:
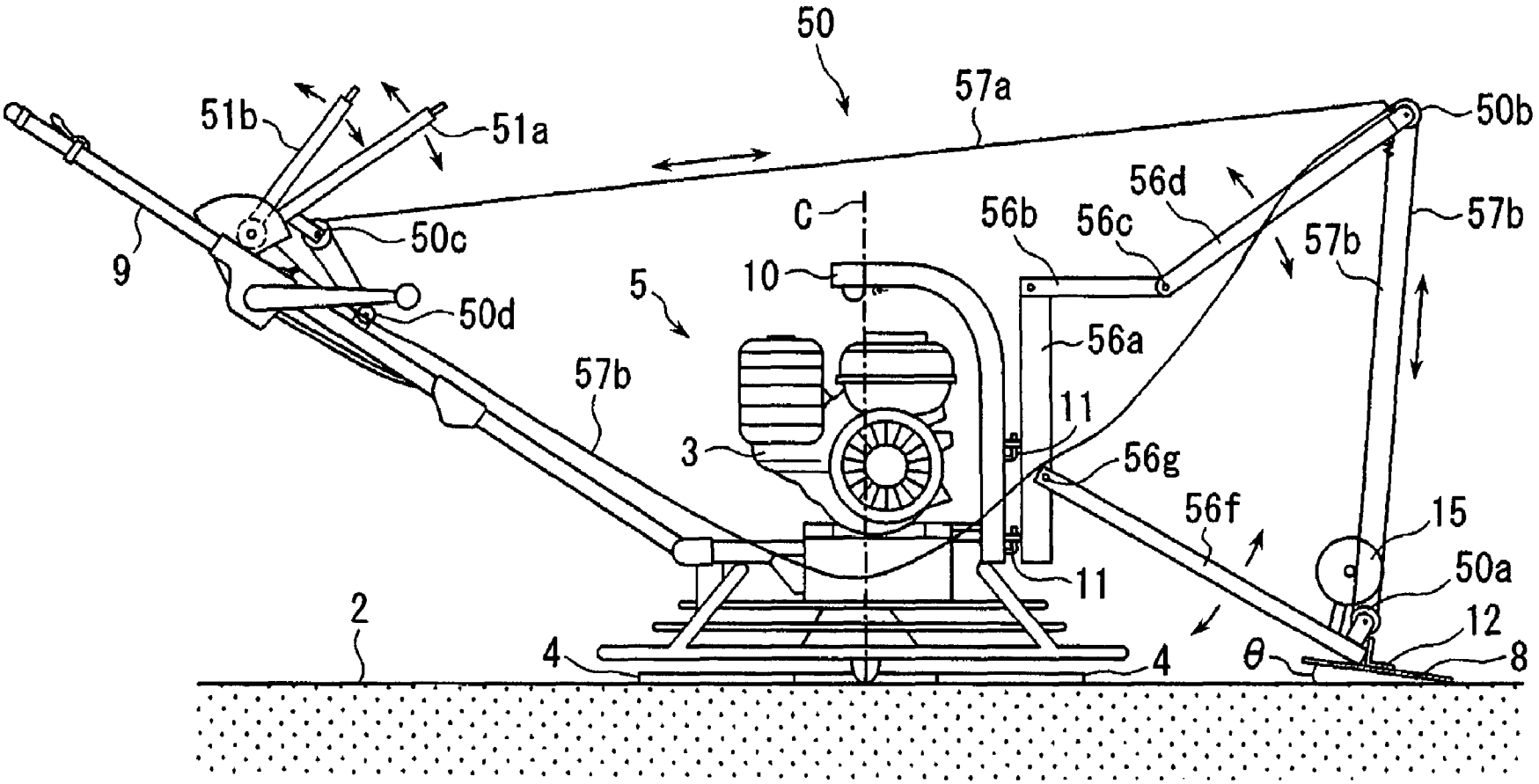
FIG. 12 is a side view illustrating a floor surface finishing device which is a fourth embodiment of the present invention.

Next, in the floor surface finishing device 50 shown in FIG. 12, a vertical shaft 56*a* is mounted on a hook 11 on a support of a plane leveling machine 5, and a base end portion of an elevating arm 56*f* is rotatably pivoted on a shaft 56*g* provided on a portion close to a lower end of the vertical shaft 56*a*. A base end portion of an auxiliary elevating arm 56*d* is rotatably pivoted on a shaft 56*c* provided on a distal end of a horizontal shaft 56*b* which extends from an upper end of the vertical shaft 56*a* frontward. A pulley 50*a* is disposed on a distal end portion of the elevating arm 56*f*, a pulley 50*b* disposed on a distal end portion of the auxiliary elevating arm 56*d*, a pulley 50*c* disposed on an elevating lever 51*a*, and a pulley 50*d* disposed on an operating handle 9.

A wire 57*a* with its distal end portion fixed on a top surface of the distal end portion of the auxiliary elevating arm 56*d* extends through the pulley 50*c* and the pulley 50*d* and is fixed to the pulley 50*c*. A wire 57*b* with its distal end portion fixed on a bottom surface of the auxiliary elevating arm 56*d* extends through the pulley 50*a* and the pulley 50*b* and is fixed to an auxiliary elevating lever 51*b*.

When the elevating lever 51*a* is tilted, the wire 57*a* is let in and out, thereby rotating the auxiliary elevating arm 56*d* centering around the shaft 56*c*. At this time, the elevating arm 56*f* rotates (pivots) centering around the shaft 56*a* in a relatively large motion via the wire 57*b* in a state of being stretched between the pulleys 50*a* and 50*b*. Therefore, a finishing blade 8, a plumb bob 15 and other members can be lifted and lowered within a relatively wide range of height. On the other hand, when the auxiliary elevating lever 51*b* is tilted, the wire 57*b* is let in and out, thereby rotating the elevating arm 56*f* centering around the shaft 56*g* within a relatively narrow range so that the finishing blade 8 can come into contact with and separate from a floor surface to be finished 2*a*.

Accordingly, during floor finishing operations, the auxiliary elevating lever 51*b* is manipulated to make the finishing blade 8 come into contact with and separate from the floor surface to be finished 2. After completing the floor finishing operations, the elevating lever 51*a* is manipulated to lift up high the finishing blade 8, the plumb bob 15, and other members. In this manner, in the floor surface finishing device 50, by tilting operations of each of the elevating lever 51*a* and the auxiliary elevating lever 51*b* which are disposed at the hands of an operator standing at a position of the operating handle 9, the finishing blade 8 can be moved in lifting and lowering directions, which leads to easy manipulation and excellent operability.

Next, with reference to FIGS. 13 to 16, floor surface finishing devices according to fifth to seventh embodiments of the present invention will be explained below. In components of floor surface finishing devices 60, 70 and 80 shown in FIGS. 13 to 16, the components which have the same structures and functions as those of the above-mentioned floor surface finishing device 1 bear the same reference numerals as in FIGS. 1 to 12 and the explanations are omitted.

Figure 13:
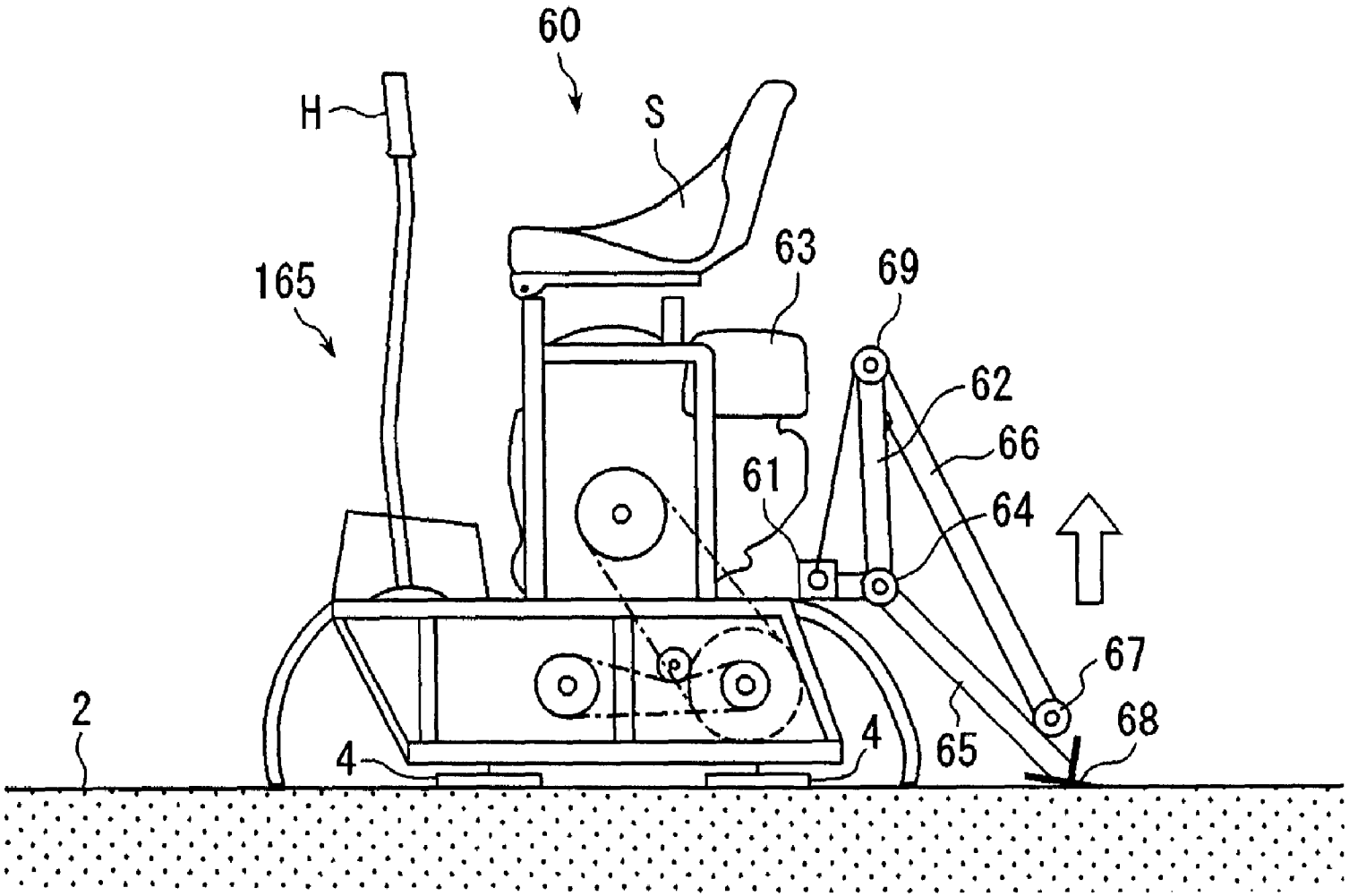
FIG. 13 is a side view illustrating a floor surface finishing device which is a fifth embodiment of the present invention.
Figure 14:
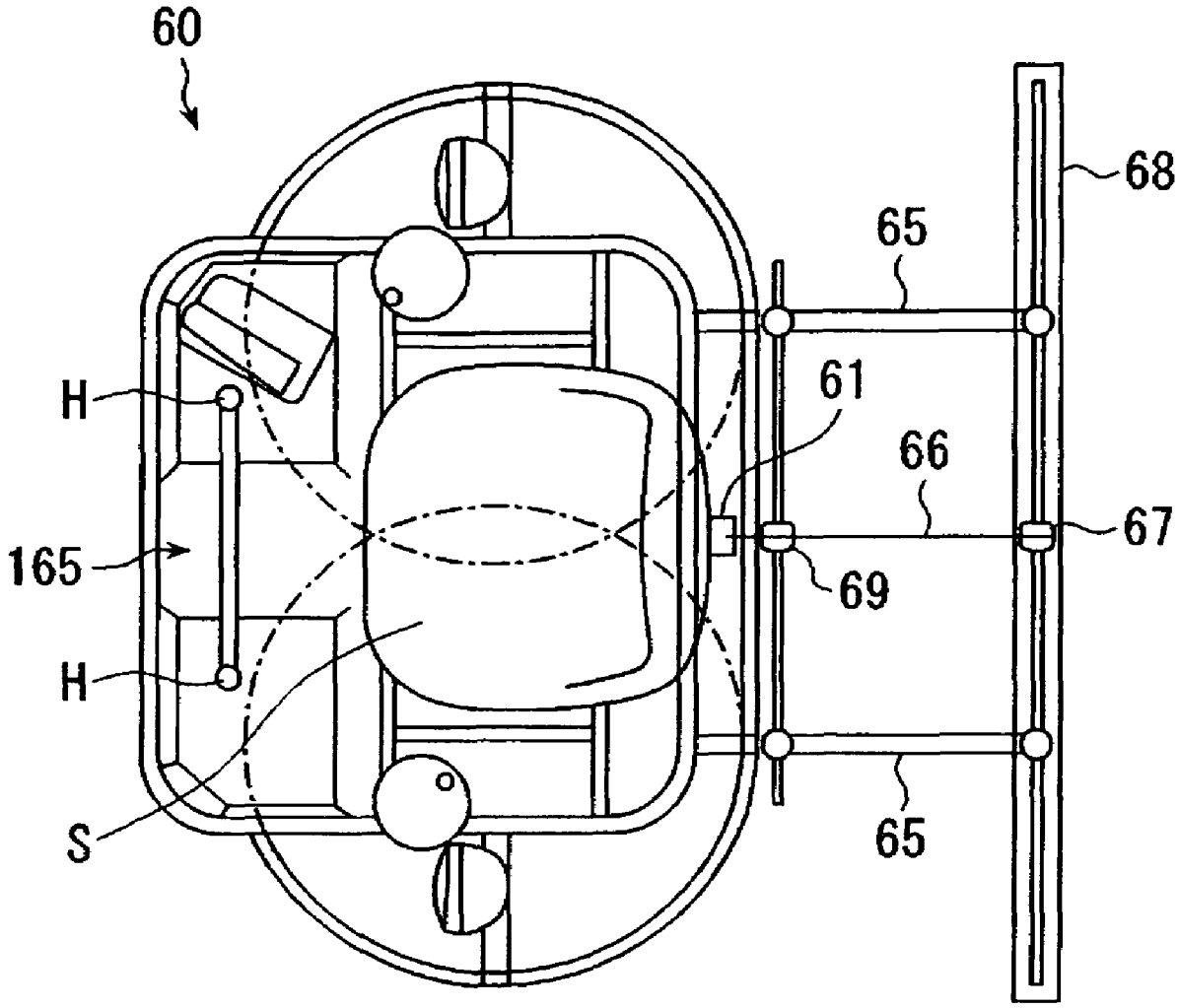
FIG. 14 is a plan view illustrating the floor surface finishing device in FIG. 13.

The floor surface finishing device 60 shown in FIGS. 13 and 14 comprises a plane leveling machine 165 having two groups of rotary blades 4 disposed at two positions on right and left sides which are driven by a motor 63, a finishing blade 68 connected to the plane leveling machine 165 via an elevating arm 65, and seat S on which an operator sits. The elevation arm 65 is rotatably pivoted on a shaft 64. A pulley 67 is disposed on a portion close to a distal end of the elevating arm 65, and a pulley 69 is disposed on an upper end portion of a vertical shaft 62 standing on a base end portion of the elevating arm 65. A wire 66 with its distal end portion fixed on the vertical shaft 62 extends through a pulley 67 and a pulley 69 and is fixed to a hoist 61 which is electrically driven. An operator sits on the seat S and manipulates two operating handles H to move the plane leveling machine 165 backward and forward and from side to side or to change the direction.

While rotating the rotary blades 4 of the plane leveling machine 165 with a part of the finishing blade 68 coming into contact with a floor surface to be finished 2*a*, an operator sitting on the seat S moves the floor surface finishing device 60 forward (toward a left side in FIG. 13), thereby conducting a floor surface finishing operation by a similar action to that of the above-described floor surface finishing device 1. As the operator can conduct the operation while sitting on the seat S, his/her physical load can be alleviated. Furthermore, the finishing blade 68 can be lifted and lowered by activating the electrically-driven hoist 61 with a predetermined operating switch (not shown), which improves operability. In addition, the floor surface finishing device 60 is provided with the finishing blade 68 which has a larger longitudinal size compared to the above-described floor surface finishing device 1, enabling a finishing operation over a large area of the floor surface to be finished 2*a*, which considerably promotes efficiency of the operation.

Figure 15:
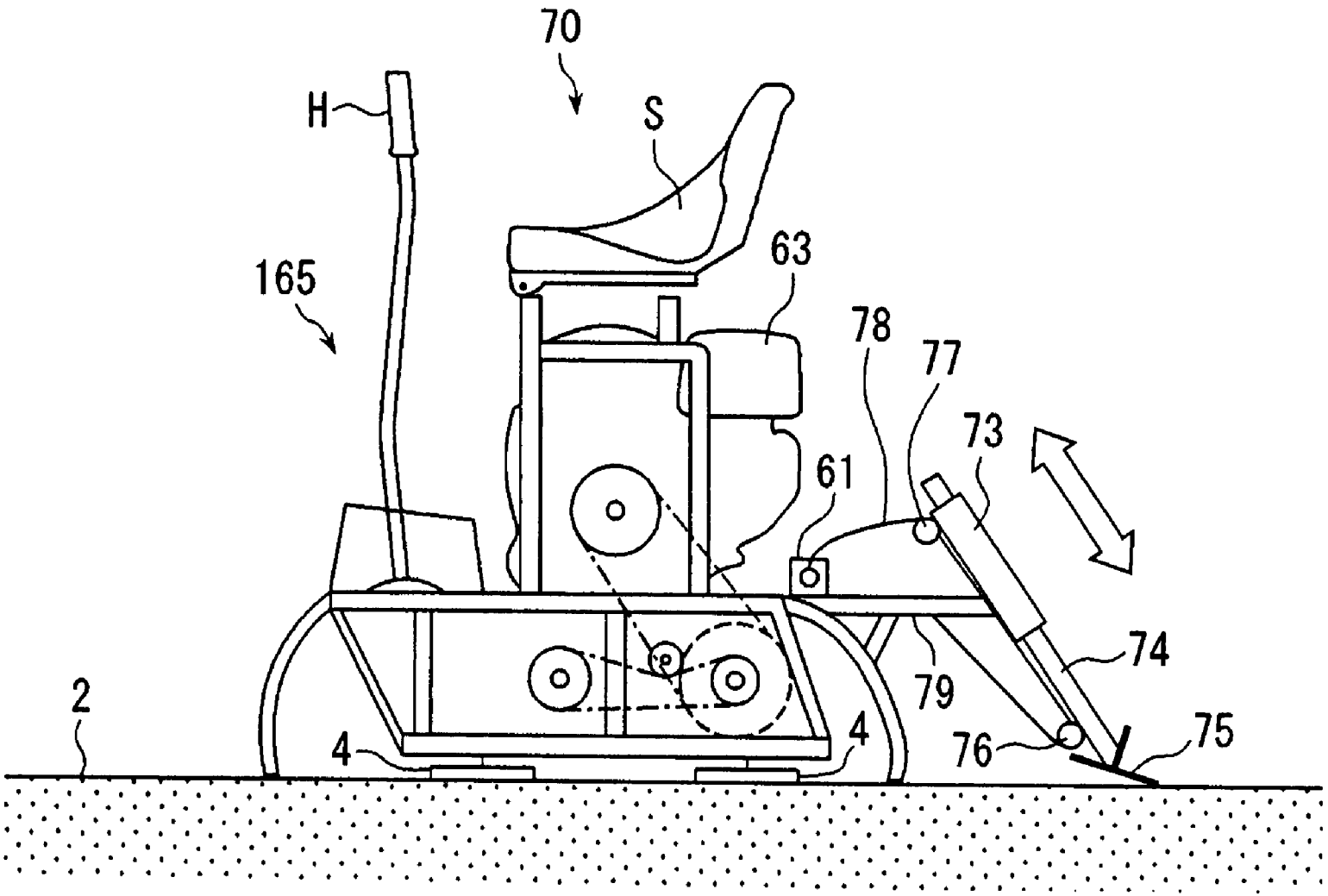
FIG. 15 is a side view illustrating a floor surface finishing device which is a sixth embodiment of the present invention.

Next, in the floor surface finishing device 70 shown in FIG. 15, an elevating arm 74 is slidably inserted inside a tubular member 73 which is fixed slantwise (at an angle to the horizontal direction) to a distal end of a horizontal shaft 79 extending from a rear portion of the plane leveling machine 165. A finishing blade 75 is attached to a distal end portion of the elevating arm 74. A pulley 76 is disposed at a portion close to the distal end portion of the elevating arm 74, and a pulley 77 is disposed on an upper end portion of the tubular member 73. A wire 78 with its distal end portion fixed on the horizontal shaft 79 extends through the pulley 76 and the pulley 77 and is fixed to a hoist 61 which is electrically driven. An operating method for the floor surface finishing device 70 is similar to the method for the above-described floor surface finishing device 60. On the other hand, in the floor surface finishing device 70, an elevating mechanism of the finishing blade 75 can be formed of the tubular member 73 and the elevating arm 74, which simplifies the structure.

Figure 16:
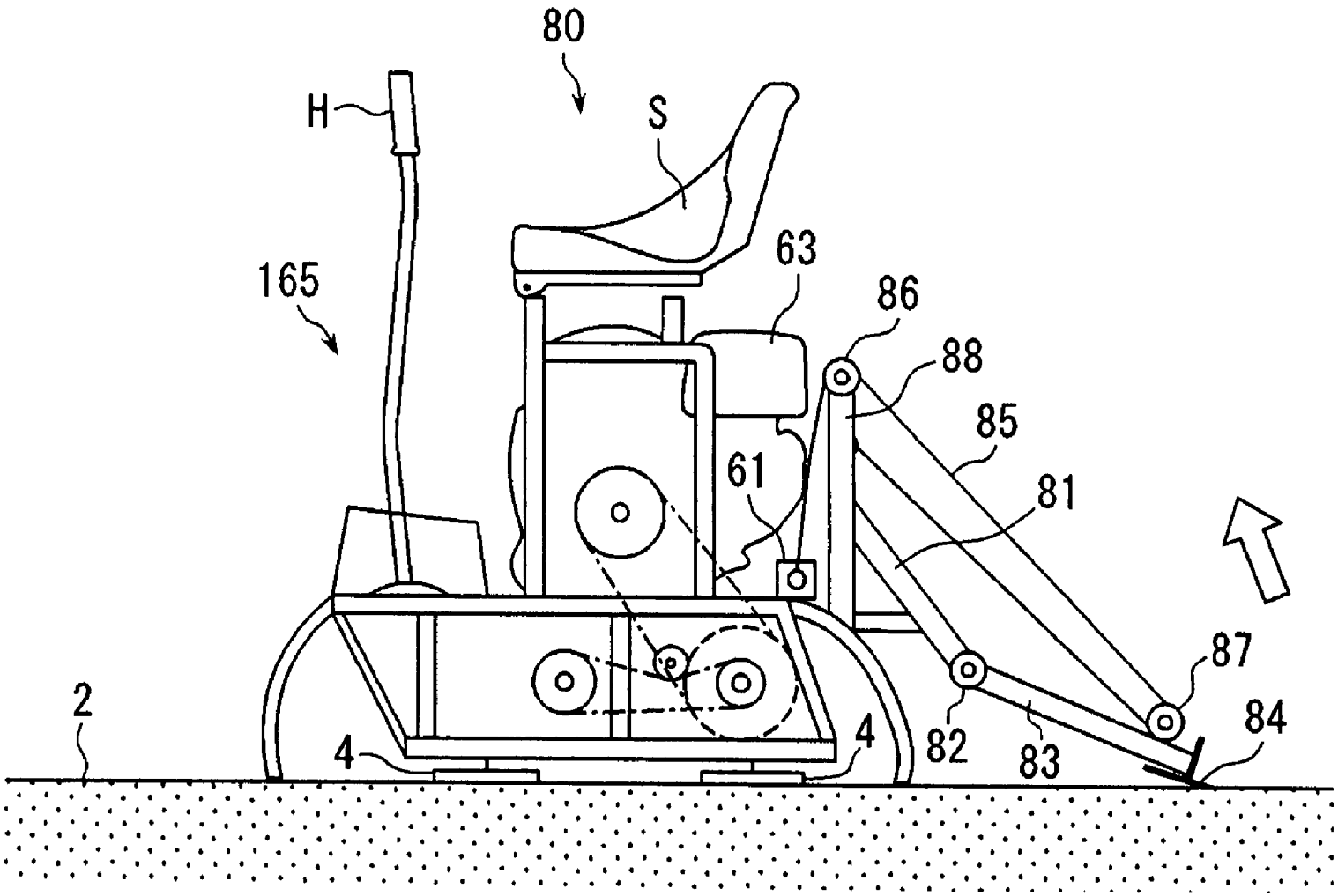
FIG. 16 is a side view illustrating a floor surface finishing device which is a seventh embodiment of the present invention.

Next, in the floor surface finishing device 80 shown in FIG. 16, an elevating arm 83 is rotatably pivoted on a shaft 82 provided on a distal end of a slanted shaft 81 which is fixed slantwise to a vertical shaft 88 standing on a rear portion of the plane leveling machine 165. A finishing blade 84 is attached to a distal end portion of the elevating arm 83. A pulley 87 is disposed at a portion close to the distal end portion of the elevating arm 83, and a pulley 86 is disposed at an upper end portion of the vertical shaft 88. A wire 85 with its distal end portion fixed on the vertical shaft 88 extends through the pulley 87 and the pulley 86 and is mounted on a hoist 61 which is electrically driven. The floor surface finishing device 80 exhibits the effect similar to that of the above-described floor surface finishing device 60.

The place where the electrically-driven hoist 61 used in the floor surface finishing devices 60, 70 and 80 is installed is not limited to the positions shown in FIGS. 13 to 16 but can be varied depending on use conditions and operating situations.

In the floor surface finishing devices 1, 30, 40, 50, 60, 70 and 80, a wire is used as a mechanism for lifting and lowering a finishing blade, and a human power or an electric motor is used as a driving power thereof. However, the present invention is not limited to these members. The mechanism for lifting and lowering a finishing blade can be composed of an air cylinder activated by an electric motor or a motor, a link mechanism using a hydraulic cylinder, a belt mechanism, a chain mechanism, a cam mechanism, or the like, and the elevation of the finishing blade and the adjustment of an angle of attack can be conducted with a switching operation. When employing an air cylinder, a hydraulic cylinder, or the like, the finishing blade can not only be moved upward and downward but also be maintained at a predetermined position and with a predetermined angle of attack. Therefore, it is also possible to omit a plumb bob which is used as a pressing means against a floor surface to be finished.

Next, with reference to FIGS. 17 and 18, floor surface finishing devices according to eighth and ninth embodiments of the present invention will be explained below. In the components of floor surface finishing devices 90 and 100 shown in FIGS. 17 and 18, the components which have the same structures and functions as those of the above-mentioned floor surface finishing device 1 and the like bear the same reference numerals as in FIGS. 1 to 12 and the explanations are omitted.

Figure 17:
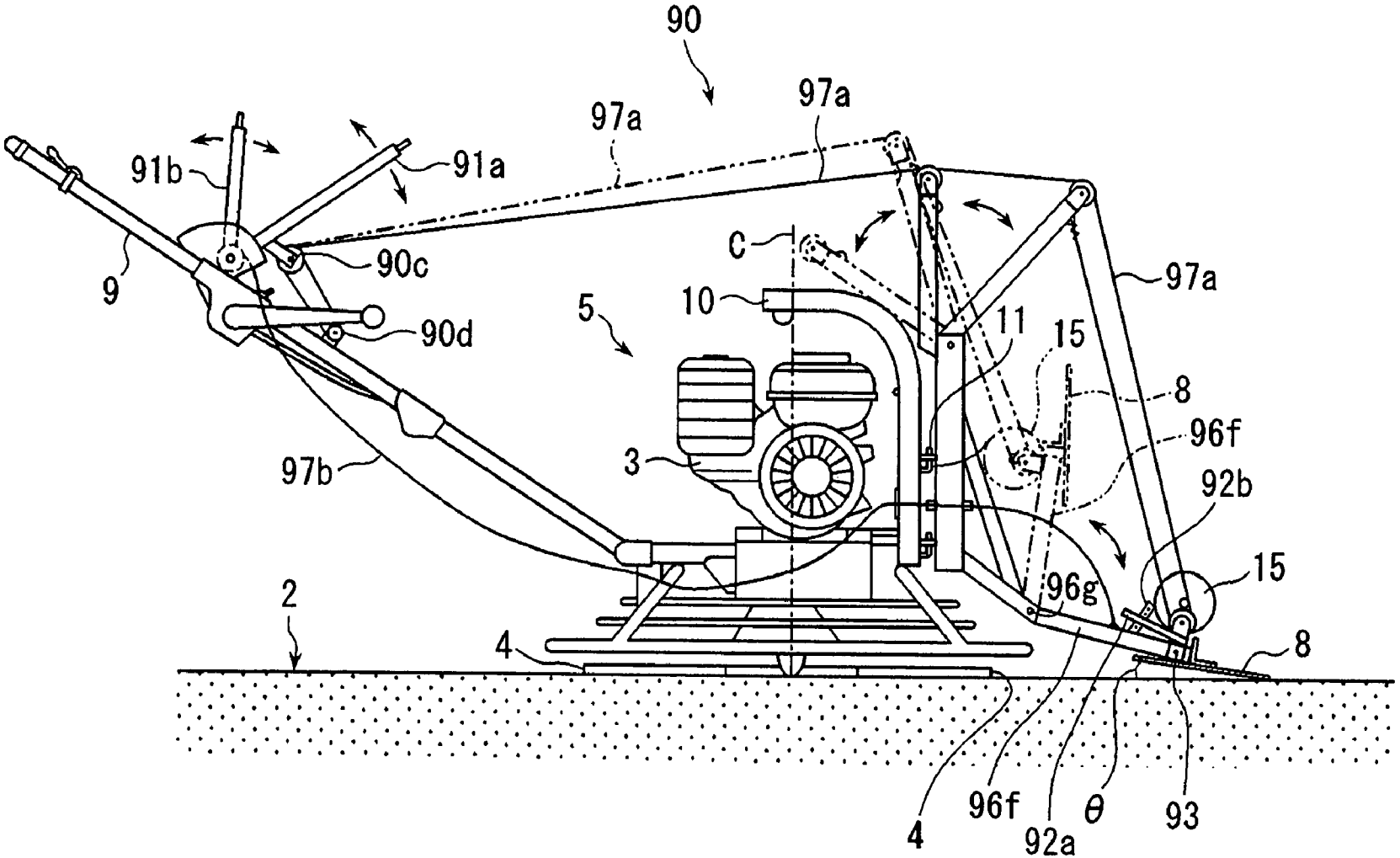
FIG. 17 is a side view illustrating a floor surface finishing device which is an eighth embodiment of the present invention.

In the floor surface finishing device 90 shown in FIG. 17, by tilting an elevating lever 91*b*, an elevating arm 96*f* is rotated within a relatively small range centering around a shaft 96*g* via a wire 97*a*, thereby lifting and lowering a finishing blade 8. By tilting an auxiliary elevating lever 91*a*, the elevating arm 96*f* is rotated (pivoted) within a relatively large range centering around the shaft 96*g*. Thus, as shown in an imaginary line in FIG. 17, the finishing blade 8 can be lifted in a nearly vertical position and housed on a side of a plane leveling machine 5. At this time, a plumb bob 15 is also positioned closely to a center of gravity of the plane leveling machine 5, which prevents decline of operability when only the function of the plane leveling machine 5 is used for a floor leveling operation.

Closely to a distal end of the elevating arm 96*f*, an angle adjusting lever 92*a*, as well as the finishing blade 8 which rotates centering around a shaft 93, and a mounting member 92*b* which defines a holding position of the angle adjusting lever 92*a*, are provided. Thus, by changing the holding position of the angle adjusting lever 92*a* in relation to the mounting member 92*b*, an angle of attack θ of the finishing blade 8 can be varied.

Figure 18:
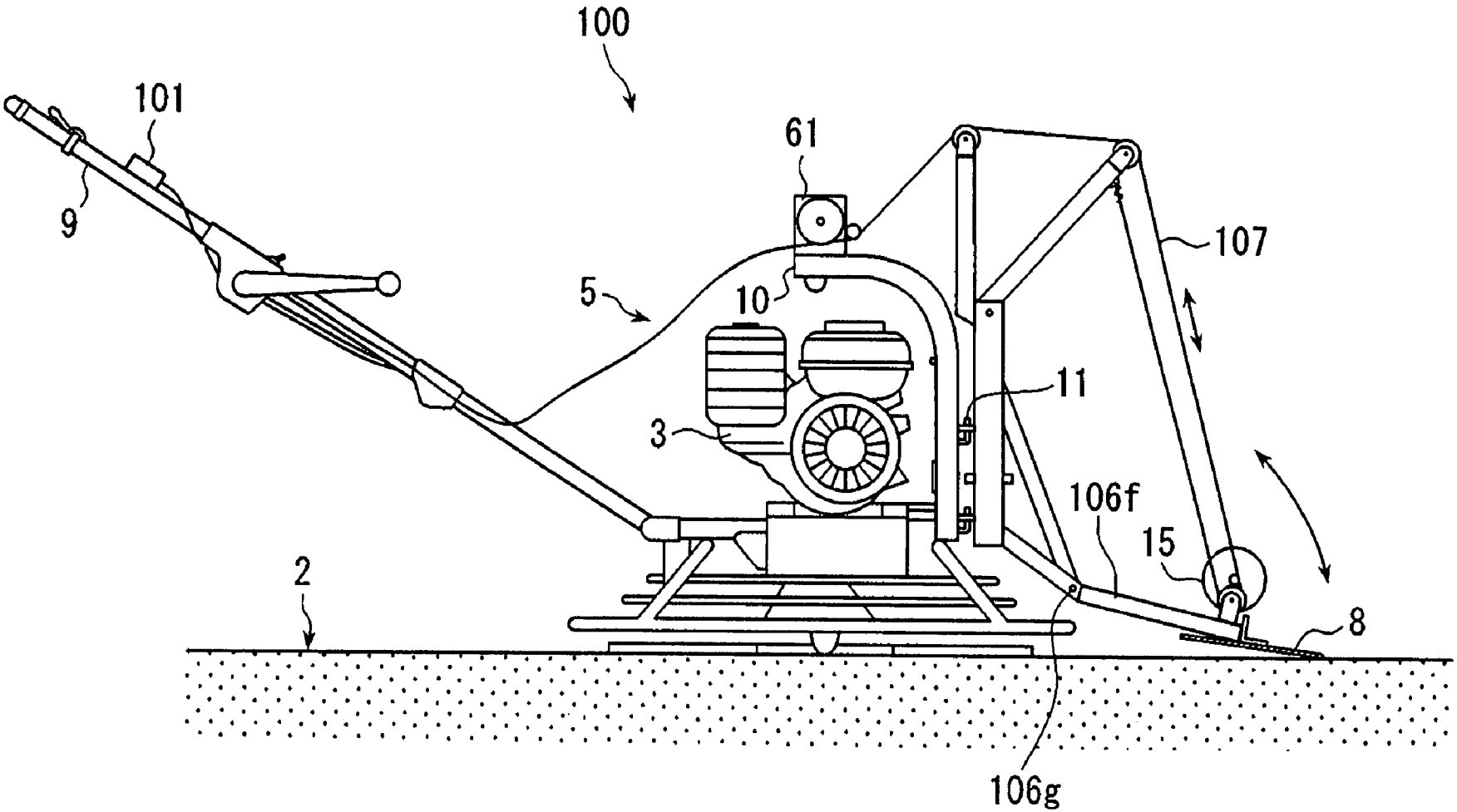
FIG. 18 is a side view illustrating a floor surface finishing device which is a ninth embodiment of the present invention.

Next, in the floor surface finishing device 100 shown in FIG. 18, when an operator manipulates a switch 101 disposed on an operating handle 9, an electrically-driven hoist 61 disposed on a support 10 of a plane leveling machine 5 is activated to wind up or reel out a wire 107. In this manner, an elevating arm 106*f* rotates centering around a shaft 106*g*, thereby lifting and lowering a finishing blade 8 and a plumb bob 15. An operator can move the finishing blade 8 up and down simply by manipulating the switch 101 at his/her hands, which leads to good operability and reduced physical load. The position where the electrically-driven hoist 61 is installed is not limited only to the position on the support 10 but can be appropriately selected depending on using conditions and operating situations.

INDUSTRIAL APPLICABILITY

The floor surface finishing device in the present invention can be widely used in an industrial field where finishing operations of concrete floor surfaces or mortar floor surfaces are conducted.

The invention claimed is:

1. A floor surface finishing device comprising:

a plane leveling machine including a plurality of rotary blades operable to rotate in a propeller manner by a driving force while maintaining contact with a floor surface to be finished;

a planar finishing blade located at an outer periphery of an area of rotation of said rotary blades, at least a portion of said finishing blade being formed of a flexible elastic plate, said finishing blade being angled upwards toward a center axis of rotation of said rotary blades and operable to contact the floor surface to be finished after said rotary blades have contacted and passed over the floor surface to be finished, said finishing blade being connected to said plane leveling machine such that said finishing blade is operable to:

move in directions toward and away from the floor surface to be finished; and swing around said rotary blades;

a plumb bob for pressing said finishing blade against the floor surface to be finished; and a connecting member for connecting said finishing blade to said plane leveling machine, said connecting member including an elevating arm pivotally connected to said plane leveling machine so as to allow said finishing blade to move in a vertical direction and to swing around said rotary blades in a horizontal direction such that at least a part of said finishing blade contacts the floor surface to be finished after said rotary blades have contacted and passed over the floor surface to be finished.

2. The floor surface finishing device of claim 1, further comprising an angle adjusting mechanism for varying an angle of said finishing blade relative to the floor surface to be finished.

3. The floor surface finishing device of claim 1, wherein said finishing blade is detachably connected to said plane leveling machine.

4. The floor surface finishing device of claim 1, further comprising a seat for supporting an operator, said seat being provided on a part of said plane leveling machine.

5. The floor surface finishing device of claim 1, further comprising a lifting mechanism for moving said finishing blade in the directions toward and away from the floor surface to be finished.

6. The floor surface finishing device of claim 1, wherein said connecting member further includes a vertical shaft pivotally attached to said plane leveling machine, and a horizontal shaft attached to and extending from said vertical shaft, said elevating arm being supported by said vertical shaft and said horizontal shaft so as to extend outwardly from said plane leveling machine, said finishing blade being attached to a distal end of said elevating arm.

7. The floor surface finishing device of claim 6, wherein said connecting member further includes a supporting member arranged at an angle between said vertical shaft and said horizontal shaft, a base end of said elevating arm opposite said distal end being adjustably and pivotably attached to said supporting member such that said elevating arm is pivotable in the vertical direction.

8. The floor surface finishing device of claim 7, wherein said connecting member further includes a pulley mounted at said distal end of said elevating arm, further comprising a wire having a first end attached to said horizontal shaft and extending around said pulley and through a wire guide mounted at a distal end of said horizontal shaft, a second end of said wire being connected to an operating handle for pivoting said elevating arm in the vertical direction.

9. The floor surface finishing device of claim 6, wherein said connecting member further includes a pulley mounted at said distal end of said elevating arm, further comprising a wire having a first end attached to said horizontal shaft and extending around said pulley and through a wire guide mounted at a distal end of said horizontal shaft, a second end of said wire being connected to an operating handle for raising and lowering said elevating arm.

* * * * *